US008438679B2

(12) United States Patent
Wootten, Jr.

(10) Patent No.: US 8,438,679 B2
(45) Date of Patent: May 14, 2013

(54) BEDDING SYSTEM AND THE LIKE HAVING ORIENTATION MEANS

(75) Inventor: Gerald Wootten, Jr., Cullman, AL (US)

(73) Assignee: Homtex, Inc., Vinemont, AL (US)

( * ) Notice: Subject to any disclaimer, the term of this patent is extended or adjusted under 35 U.S.C. 154(b) by 0 days.

(21) Appl. No.: 12/177,464

(22) Filed: Jul. 22, 2008

(65) Prior Publication Data

US 2009/0205134 A1 Aug. 20, 2009

Related U.S. Application Data

(60) Provisional application No. 61/029,188, filed on Feb. 15, 2008.

(51) Int. Cl.
*A47C 31/10* (2006.01)

(52) U.S. Cl.
USPC ..... 5/482; 5/488; 5/499; 5/497

(58) Field of Classification Search ..... 5/482, 499, 5/497, 496, 504.1
See application file for complete search history.

(56) References Cited

U.S. PATENT DOCUMENTS

| | | | | |
|---|---|---|---|---|
| 1,907,393 | A | 5/1933 | Tooley | |
| 2,059,092 | A * | 10/1936 | Donovan | 40/662 |
| 4,680,821 | A * | 7/1987 | Maguire | 5/413 R |
| 4,802,250 | A | 2/1989 | Farr | |
| 4,934,939 | A * | 6/1990 | Bonneville | 434/247 |
| 5,479,664 | A * | 1/1996 | Hollander | 5/499 |
| 5,655,236 | A * | 8/1997 | Murray | 5/495 |
| 5,809,593 | A * | 9/1998 | Edwards | 5/497 |
| 6,230,341 | B1 * | 5/2001 | Dudley | 5/482 |
| 6,532,608 | B2 * | 3/2003 | Schreiner | 5/497 |
| 6,842,921 | B1 * | 1/2005 | Tsiarkezos et al. | 5/497 |
| 6,983,500 | B2 * | 1/2006 | Wootten | 5/497 |
| 7,340,785 | B2 | 3/2008 | Weedling et al. | |
| 7,398,570 | B2 * | 7/2008 | Seago | 5/497 |
| 2006/0000016 | A1 * | 1/2006 | Weedling et al. | 5/81.1 HS |
| 2007/0056100 | A1 * | 3/2007 | Stewart | 5/497 |
| 2008/0115271 | A1 * | 5/2008 | Wiley | 5/497 |

FOREIGN PATENT DOCUMENTS

| | | |
|---|---|---|
| GB | 1121856 | 7/1968 |
| GB | 1546904 | 5/1979 |

OTHER PUBLICATIONS

Yahoo! Answers, King size sheet orientation!, Aug. 9, 2007, Yahoo!*
Supplemental European Search Report for application No. EP 0971 1336.
"Bedding Designed Just for you"—with handwritten note, Your Total Sleep Solution, http://www.sleepnumber.com/eng/whySleepNumber/your Total Sleep Solution.cfm, Jun. 21, 2011, 2 pages.

* cited by examiner

*Primary Examiner* — Robert G Santos
*Assistant Examiner* — Brittany Wilson
(74) *Attorney, Agent, or Firm* — Pearne & Gordon LLP

(57) ABSTRACT

An article for use on a mattress includes a bedding article and means for orienting the bedding article on a mattress. The means for orienting the bedding article on a mattress may be hidden from view when the bedding article is installed on a mattress. The means for orienting the bedding article on a mattress may be one or more of color contrasting sections, indicia, labels, or stitching. The bedding article has two sides, a top end, a bottom, an opening for seating around the bed, an edge around the opening, and four corners, with two corners being at the top end and two corners being at the bottom end. An article for use as a cover for an underlying item is also disclosed, with the article including a cover article and means for orienting the cover article on an underlying item.

9 Claims, 18 Drawing Sheets

BEDDING SYSTEM AND THE LIKE HAVING ORIENTATION MEANS

CROSS-REFERENCE TO RELATED APPLICATION

This application claims priority to U.S. Provisional Application No. 61/029,188, filed Feb. 15, 2008, the disclosure of which is incorporated herein by reference in its entirety.

FIELD

The technology described in this patent document relates generally to coverings, such as bed coverings, and the like.

BACKGROUND

Anyone who has ever tried to position a fitted sheet on a king size mattress will recognize that its often difficult to orient the sheet in the proper orientation on the mattress on the first try. Properly orienting bedding often involves trial and error, with one end of the bedding article being positioned on an end of a mattress while the other end of the bedding article is pulled up around the other end of the mattress to see whether it fits. If the bedding article is oriented in the wrong direction, the bedding article will not fit and the consumer will need to start over by rotating the bedding article by 90 degrees. Fitted mattress pads and fitted sheets are often most difficult, since they have a tendency to spring off of the mattress while the consumer is trying to position them properly. Two persons may often be needed to position the fitted mattress pad or fitted sheet on a mattress, with one person holding one or more corners in place while the other person moves the bedding article around the sides and under the mattress. It can be especially frustrating when a single person is attempting to make a bed by themselves.

Some mattress sizes are more difficult than others to determine proper placement of a bedding article. For example, a standard size twin mattress has a length of 75 inches and a width of 35 inches. A standard size full (or double) mattress has a length of 75 inches and a width of 53 inches. A standard size queen mattress has a length of 80 inches and a width of 60 inches. A standard size king mattress has a length of 80 inches and a width of 76 inches. A crib mattress has a length of 52 inches and a width of 27 inches. Mattresses may have varying thicknesses based upon their construction. As is evident, the larger the mattress, the closer to square the mattress becomes. The closer a mattress is to a square, the harder it is to discern which way a bedding article fits on the mattress. While it may be relatively easy to determine which way a twin sheet fits on a mattress, it becomes more difficult with full, queen, and king-sized mattresses. There is room for improvement in the orientation of bedding on a mattress.

Other types of covers also require means for orienting. For instance, sofas or chairs that have slip or other covers may benefit from a means for orienting the covers. Patio furniture covers may also benefit from a means for orienting the covers. Any type of cover that has a predetermined preferred orientation may benefit from a means for orienting the covers, including, but not limited to seat covers, furniture covers, table covers, equipment covers, and the like.

SUMMARY

In accordance with the teachings described herein, a bedding system includes a bedding article and means for orienting the bedding article on a mattress. A cover system is also provided that includes a cover article and means for orienting the cover article on an underlying item.

DETAILED DESCRIPTION

The technology described herein relates generally to a technique for assisting in properly orienting bedding articles, such as a mattress pad or sheet, on a mattress. The technology also relates to properly orienting covers on other articles, such as furniture, equipment, pillows, cushions, and the like. Covers typically have attributes, such as color, texture, material type, stitching patterns, stitching color and the like. Different techniques for orienting are described below, including techniques that utilize orienting details like color contrast, indicia, stitching patterns and colors, labels, and other techniques.

Figure 1:
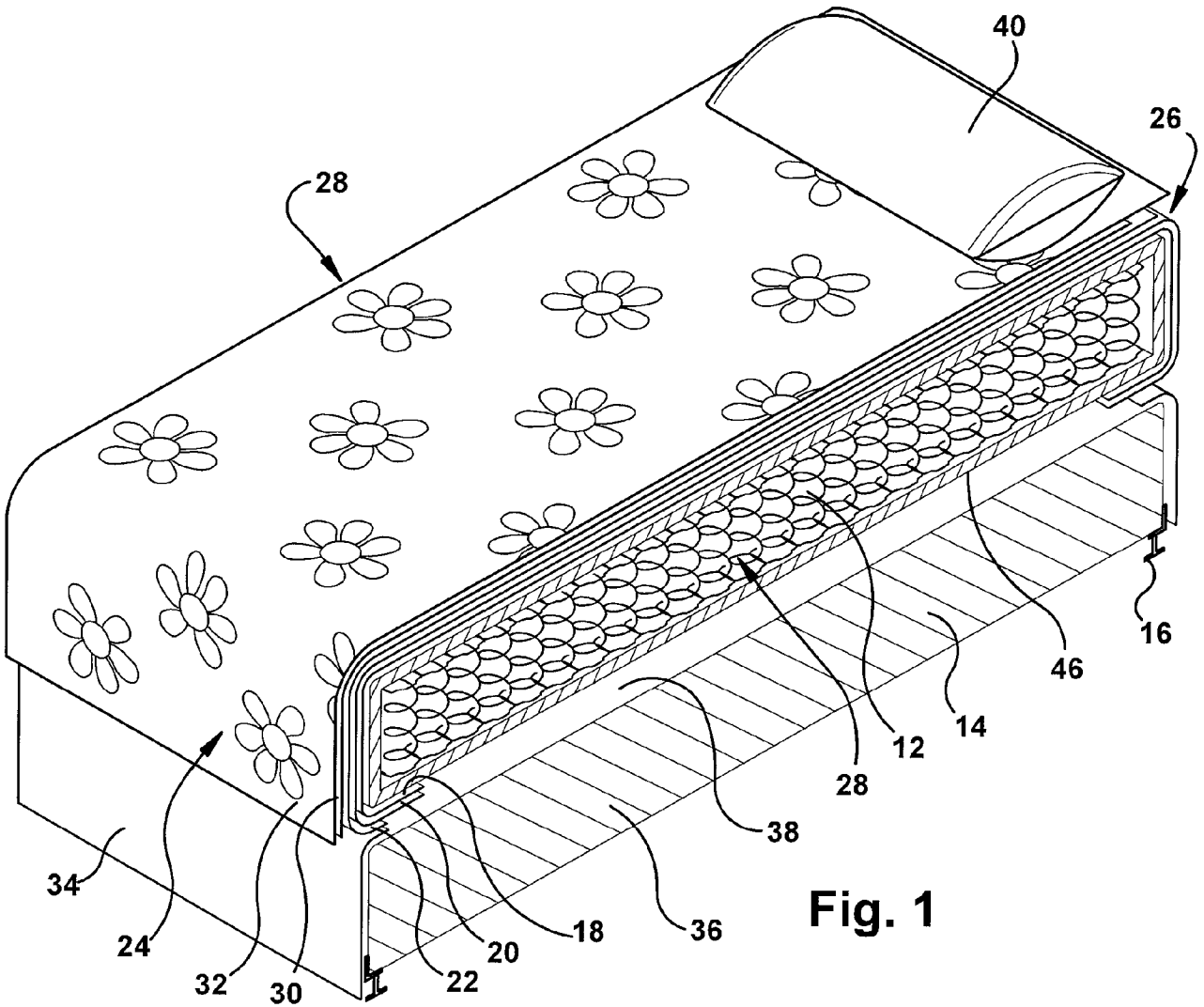
FIG. 1 depicts a prior art bedding system installed on a mattress.

A prior art bedding system 10 is depicted in FIG. 1. As shown, the bedding system 10 includes a mattress 12 and box spring 14, with the box spring 14 being positioned on a stand 16. Alternatively, the box spring 14 and mattress 12 could be positioned on a bed frame (not shown). The mattress 12 is surrounded by a mattress pad 18, which has edges that extend under the mattress 12, between the box spring 14 and mattress 12. A fitted sheet 20 is positioned adjacent the mattress pad 18. The fitted sheet 20 surrounds the mattress pad 18 and has edges that extend under the mattress 12, between the box spring 14 and the mattress 12. A flat sheet 22 is positioned over the fitted sheet 20. At the bottom end 24 of the mattress 12, the flat sheet 22 is shown tucked under the end 24 of the mattress 12. At the top end 26 of the mattress 12, the flat sheet 22 is positioned on top of the fitted sheet 20 and is spaced from the top end 26 of the mattress 12 in order to allow a person to get under the flat sheet 22 in order to lie down. Flat sheets 22 may be tucked under one or more of the mattress edges, or may alternatively be left to fall along the sides 28 or bottom end 24 of the mattress 12 without being tucked in. A blanket 30 is shown positioned over the flat sheet 22.

In FIG. 1, the blanket 30 is shown falling along the bottom end 24 of mattress 12, but not tucked in under the mattress 12. At the top end 26 of the mattress 12, the blanket 30 is spaced from the top end 26 of the mattress 12 in order to allow a person to get under the blanket 30 and flat sheet 22. The blanket 30 may alternatively be tucked in under the mattress 12 along one or more edges 24, 28 of the mattress. A comforter 32 is shown positioned over the blanket 30 and hangs along the sides 28 of the mattress 12. Comforters 32 are not typically tucked in under the mattress 12, but could be, if desired. A dust ruffle 34 is shown extending around the box spring 14. Its upper end is tucked between the mattress 12 and box spring 14, and it is usually the lowest layer of articles between the mattress 12 and box spring 14. The dust ruffle 34 falls around the sides 36, bottom 38, and sometimes top end of the box spring and can hide the box spring 14 from view. A pillow 40 with sham is shown depicted on top of the comforter 32. More than one blanket, comforter, flat sheet, fitted sheet, dust ruffle, pillow, or other items may also be used in a bedding system 10, with the typical articles being depicted.

The term "bedding article" is used herein to describe articles that can be positioned on a bed or around a mattress 12. "Bedding articles" include, but are not limited to, fitted 20 and flat sheets 22, fitted and unfitted mattress pads 18, pillow cases, pillow covers, shams, comforters 32, blankets 30, mattress toppers, duvets, feather bed covers, and the like. The term "fitted sheet" or "sheet" is used frequently in the description. The term "fitted sheet" 20 is used to refer to a type of bedding article. It should be realized that any type of bedding article may benefit from the teachings that are described via the fitted sheet 20 examples. Thus, the fitted sheet 20 examples are illustrative for all types of bedding articles. The terms "cover article" or "covering article" are used generically herein to refer to "bedding articles" and other non-bedding types of covers, including, but not limited to furniture covers (patio and non-patio) 42, seat covers, cushion covers, table covers 44, equipment covers, and the like. The term "bedding system 10," when used with "bedding articles," is meant to generically include any system that uses "bedding articles" according to the above definition. The term "covering system" refers to either a bedding item or a non-bedding item, like a sofa, chair, patio furniture, equipment, or the like, with the items being "items" that require covering. While the following description is primarily directed toward bedding, it should be readily recognized that the below described technology is equally applicable to any other type of "covering system" that will derive a benefit from an orientation means.

Figure 2:
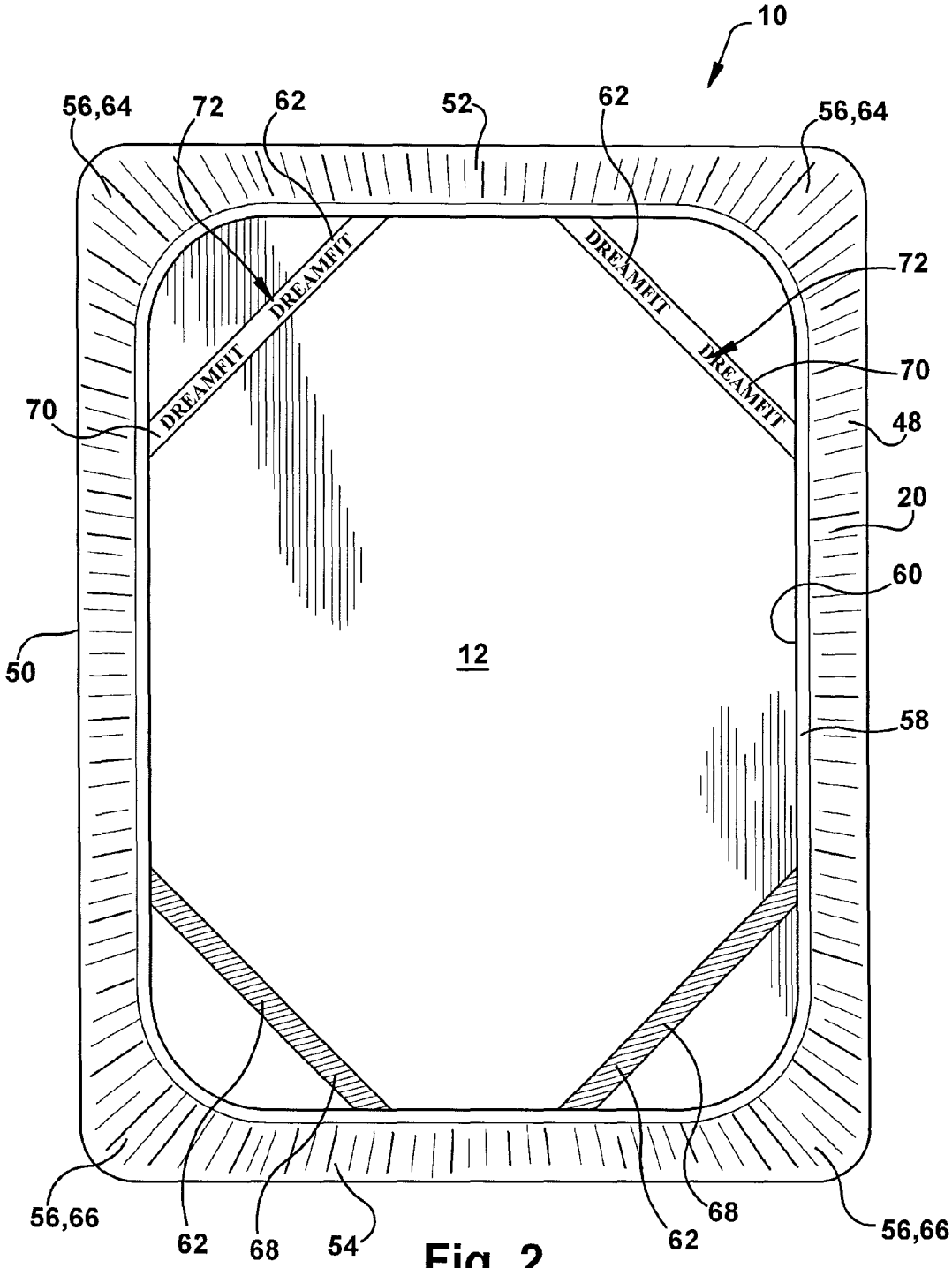
FIG. 2 depicts a bottom view a bedding system having an example means for orienting the bedding article on a mattress.

An example of a bedding article in the form of a fitted sheet 20 that utilizes a first example orientation technique is depicted in FIG. 2. The fitted sheet in FIG. 2 is shown installed around a mattress 12, from a bottom surface 46 of the mattress 12. The fitted sheet 20 includes a left side panel 48 on the left side of the mattress 12, a right side panel 50 on the right side of the mattress 12, a top panel 52 at the top end 26 of the mattress 12, and a bottom panel 54 at the bottom end 24 of the mattress 12. Each of these panels extends under the mattress and up along the side edges of the mattress. The edges of each panel are sewn together in the corners 56, and bound together at the ends by a binding technique to surround the sheet opening 60. Different binding techniques include the use of elastic tape that is sewn to the edges, an elastic binding material that wraps around and over the edges, stitching to encompass an elastic cord, and other techniques. A binding tape 58 is depicted in FIG. 2. Other techniques for finishing the edges may include partially utilizing elastic materials around the perimeter, using elasticized panels around the sides of the sheet, and the like. The sheet 20 shown in FIG. 2 uses elastic corner straps 62 in order to more strongly anchor the fitted sheet 20 to the mattress 12. Elastic corner straps 62 are discussed, for example, in U.S. Pat. No. 5,513,403 to Wooten [sic], Jr. or U.S. Pat. No. 7,316,039 to Wootten, Jr., the disclosures of which are incorporated herein by reference in their entirety.

The fitted sheet 20 of FIG. 2 utilizes both color contrast and indicia for purposes of orienting the sheet 20 on the mattress 12. In this example, the orientation means orients the fitted sheet 20 vertically. The mattress 12 upon which the fitted sheet 20 is installed is a queen size mattress, having side edges 28 that are longer than the bottom and top edges 24, 26. The standard size for a queen size mattress is 80 inches long by 60 inches wide. In this example, the orientation means are located at the top and the bottom corners. The orientation means tells the user which end of the fitted sheet fits against the top or bottom ends of a mattress 64, 66. Two orientation means examples are shown in FIG. 2. The first example utilizes elastic corner straps 62 that have a first color 68 that is different from a second color 70 of the opposing corner straps 62. For example, the two bottom corner 66 straps 62 have a different color than the two top corner 64 straps 62. The two bottom corner 66 straps 62 may have a gold color 68 while the two top 64 straps 62 have a more standard, white color 70. Other colors can be utilized, including yellow, red, blue, brown, black, green, orange, purple, silver, white, or any other known color. The straps 62 at the top corners 64 could also have a different color 68, other than white 70. For example, the top 64 straps 62 could have a second color 70 that matches the fitted sheet color while the bottom 66 straps 62 have a contrasting color 68.

An alternative example, shown in FIG. 2, utilizes indicia 72 on the corner straps 62 and can be used either in conjunction with or separately from the colored straps. For example, the two top corner 64 straps 62 have indicia 72 applied to them, in the form of advertising material (in this case a trade name), to distinguish the two top 64 straps 62 from the two bottom 66 straps 62. This indicia 72 may be stamped on, sewn on, or otherwise transferred onto the straps 62. The indicia 72 may be letters, numbers, symbols, or other markings that would suggest to a consumer that this end of the fitted sheet 20 is different from the other end or sides of the sheet 20. For example, an arrow shape could be used. The indicia 72 can be applied to colored or white straps, but the color shown in FIG. 2 is white straps. If the two bottom 66 straps 62 were also a white color, like the two top 64 straps 62, the consumer would be alerted to the top end 26 of the mattress 12 by looking for the indicia 72 on two of the four corner straps 62.

While FIG. 2 shows the colored 68 (non-white) straps 62 being positioned at the bottom end 24 and the indicia-containing 72 straps 62 positioned at the top end 26, either could be utilized to signify the top or the bottom. Thus, a consumer could alternatively position the colored 68 straps 62 at the top end 26 and the indicia 72 straps 62 at the bottom end 24. The corner straps 62 in both examples shown in FIG. 2 are advantageously positioned under the mattress 12 when the fitted sheet 20 is installed on a mattress 12, so that the straps 62 are not visible when the fitted sheet 20 is installed.

Although not shown, there may be instances where a fitted sheet 20 is only properly oriented in a single direction. An example of this may be where the fitted sheet 20 has a particular aesthetic pattern that may only be positioned properly in a single direction. If this is the case, then user instructions (not shown) would be provided with the sheet 20 so that the consumer knows that the colored 68 straps 62, for example, should only be positioned at the bottom end 24 of the mattress 12. User instructions may be provided with the sheet 20 regardless of the type of orientation.

User instructions may be in the form of written instructions provided with the packaging of the bedding article. For example, a paper insert could contain written instructions. Alternatively, a label that is directly affixed to the bedding article could be used. The label could be removable or permanent. While FIG. 2 shows a fitted sheet 20 installed on a mattress 12, any type of bedding article may be utilized that incorporates the features of the fitted sheet 20. For example, a mattress pad 18 may include corner straps 62. Flat sheets 22, comforters 32, blankets 30, and the like could include functional or non-functional corner straps 62 that are sewn on as a means for identifying the orientation of the bedding article.

Figure 3:
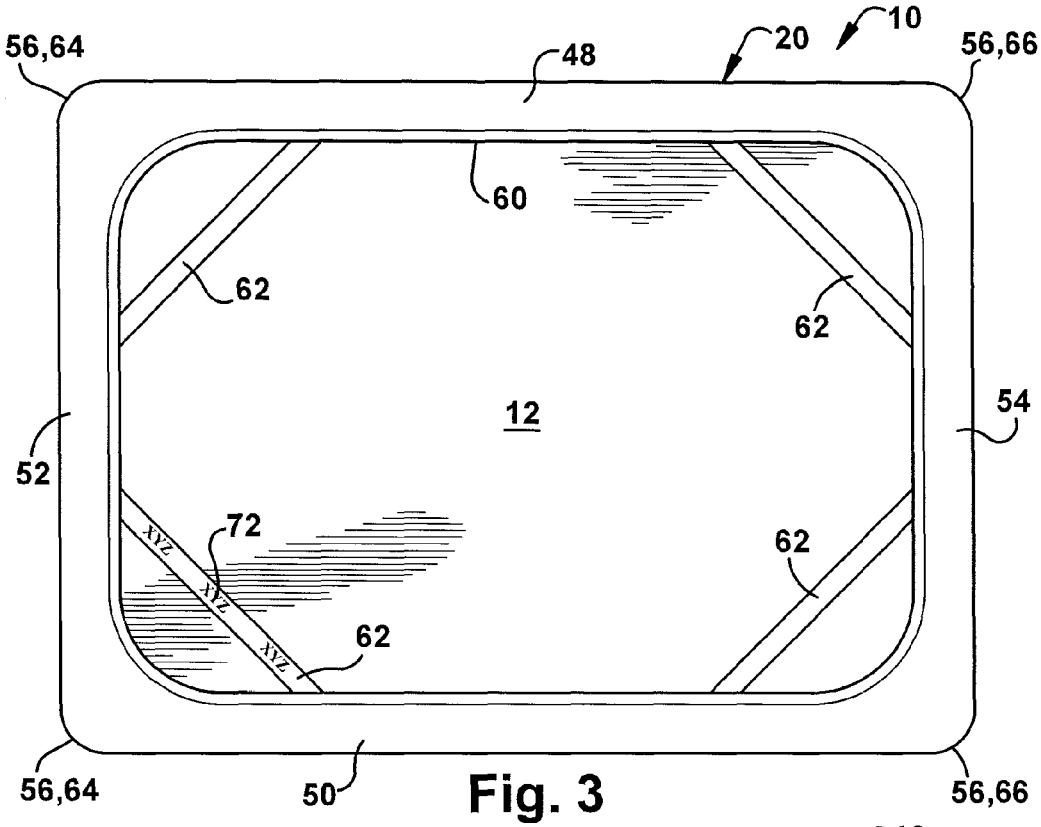
FIG. 3 depicts a bottom view of a bedding system having an alternative example means for orienting the bedding article on a mattress.

FIG. 3 depicts a bottom view of a fitted sheet 20 installed on a mattress 12. The fitted sheet 20 has corner straps 62, similar to those depicted above in FIG. 2. In this example, only one of the corner straps 62 has indicia 72 for indicating a direction. Based upon instructions that are provided with the sheet, and which are not shown, the user would be directed to know that the strap 62 with the indicia 72 should be positioned at an upper right corner or a lower left corner of the mattress 12 in order to properly orient the sheet 20 on the mattress 12. Indicia 72 may be applied to the strap 62 in any know manner, including transferring, stitching, writing, sewing, or otherwise. Direction of orientation is defined based upon the user's perspective, since the user will typically view the mattress 12 from the top surface. This is opposite from what is seen in the drawings, since the bottom view of the mattress 12 is shown.

Figure 4:
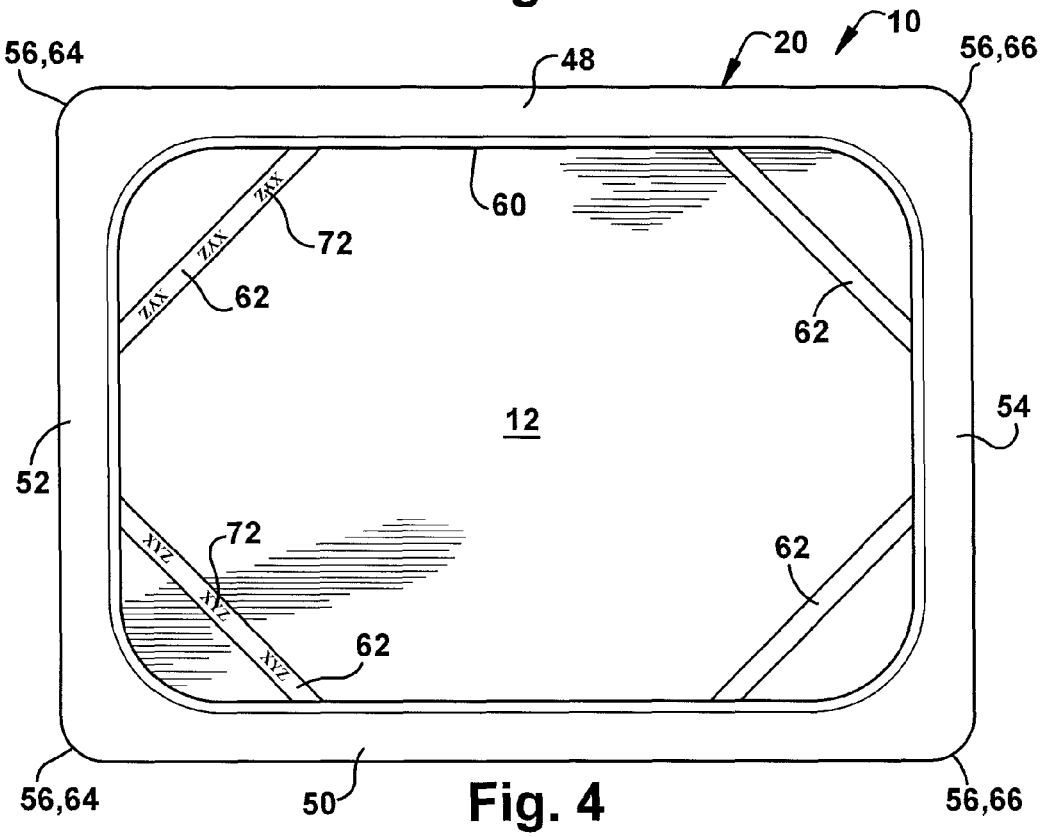
FIG. 4 depicts a bottom view of a bedding system having an alternative example means for orienting the bedding article on a mattress.

FIG. 4 depicts an example, like that discussed above in FIG. 2, where indicia 72 is provided on two of the top 64 or bottom 66 end corner straps 62 of a mattress 12 in order to indicate that that end of the bedding material is to be positioned at the top or bottom ends 26, 24 of the mattress 12. In this example, all the corner straps 62 are the same color, so the only thing indicating orientation is the indicia 72 on two straps at the end of the fitted sheet 20. Indicia 72 may be applied to the strap 62 in any known manner, including transferring, stitching, writing, sewing, or otherwise. Indicia 72 could alternatively be applied directly to the bedding article.

Figure 5:
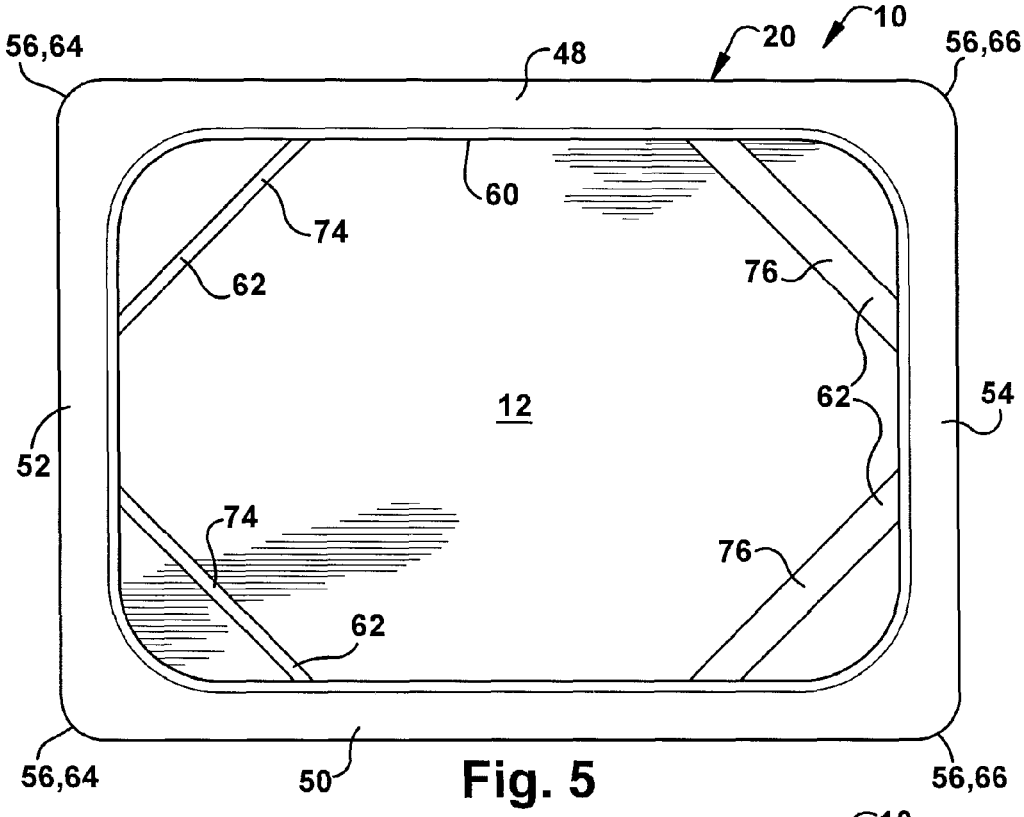
FIG. 5 depicts a bottom view of a bedding system having an alternative example means for orienting the bedding article on a mattress.

FIG. 5 depicts a bottom view of a mattress 12, with a fitted sheet 20 installed on the mattress 12. The fitted sheet 20 has an alternative means for orienting the fitted sheet 20 on the mattress 12 in the form of corner straps 62 on each of the four corners 64, 66, as discussed above. In this example, two of the corner straps 62 at the top 64 of the mattress 12 have a different width W than the two corner straps 62 at the bottom end 66 of the mattress 12. The consumer is alerted to which end of the fitted sheet 20 is to be positioned at the top or bottom of the mattress 26, 24 by identifying the like corner straps 62. The two thinner straps 74 are positioned at either the top or bottom ends 24, 26 of the mattress 12 and the two thicker straps 76 are positioned at the opposite end of the mattress 12.

Figure 6:
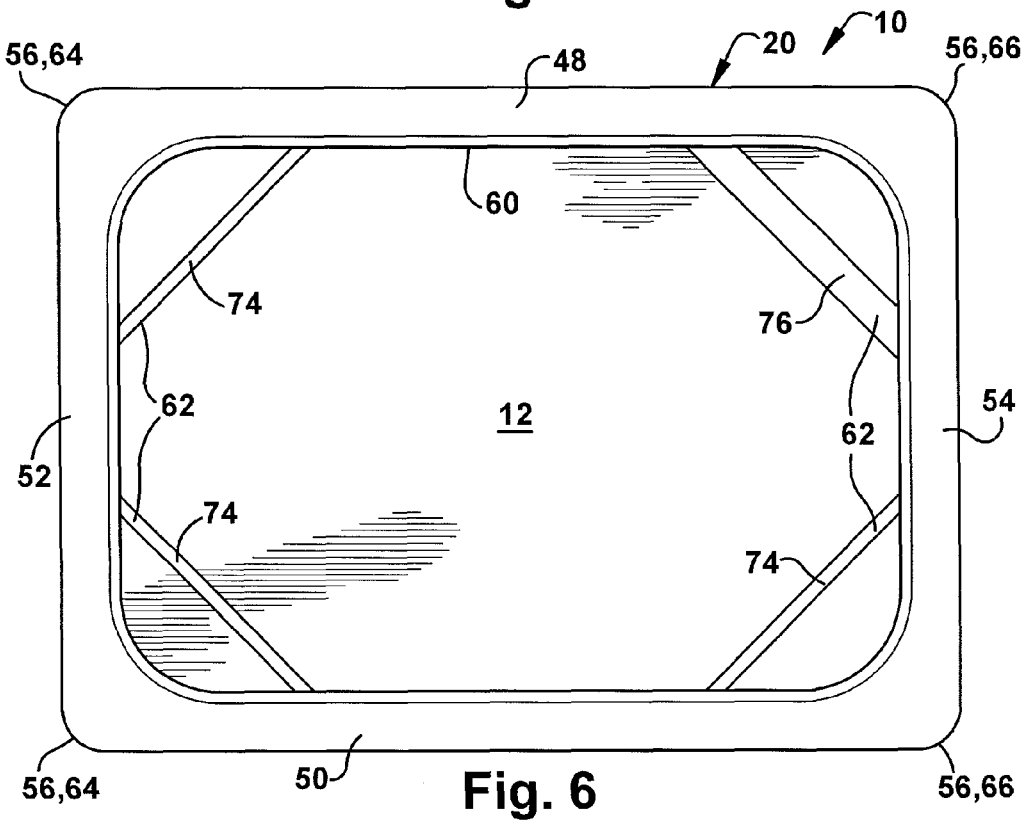
FIG. 6 depicts a bottom view of a bedding system having an alternative example means for orienting the bedding article on a mattress.

FIG. 6 depicts a bottom view of a mattress 12 with a fitted sheet 20 installed on the mattress 12. The fitted sheet 20 has another alternative means for orienting the fitted sheet 20 on the mattress 12. The fitted sheet 20 has corner straps 62 on each of the four corners 64, 66, as discussed above. In this example, one 76 of the four straps 62 has a greater width than the other three straps. The user is provided with instructions to tell them that the wider strap 76 is to be positioned at either the upper left corner of the mattress 12 or at the bottom right corner of the mattress in order to ensure proper orientation of the fitted sheet 20.

Figure 7:
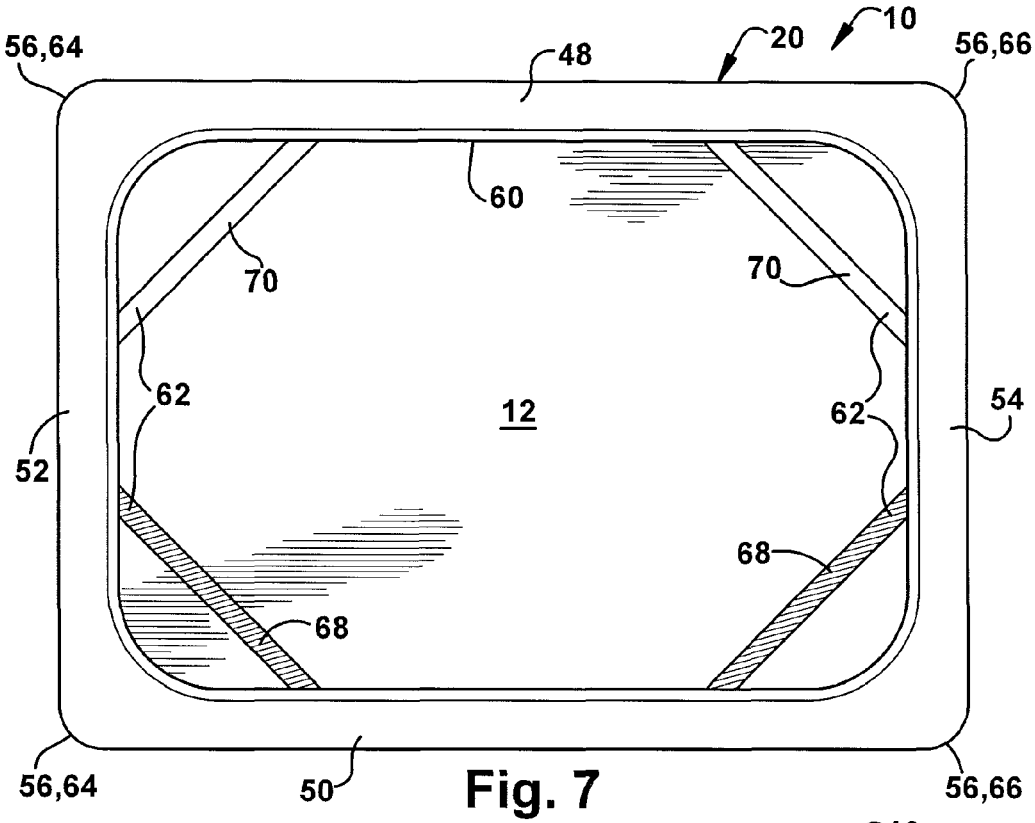
FIG. 7 depicts a bottom view of a bedding system having an alternative example means for orienting the bedding article on a mattress.

FIGS. 7-17 depict various embodiments of a fitted sheet 20 that utilize color or color contrast in order to orient a fitted sheet 20 properly on a mattress 12. In FIG. 7, a fitted sheet 20, similar to that discussed in FIG. 2, is shown positioned on a mattress 12 from a bottom view. The fitted sheet 20 has four corner straps 62, with one being positioned at each corner of the sheet. In this example, two of the four corner straps have a first color 68 that is different from a second color 70 of the other two corner straps. Instead of having the first color 68 straps denote the top or bottom end of the fitted sheet, in this example, the two first colored 68 straps identify the side edges 48, 50 of the sheet 20. Instructions may be provided with the packaging, or otherwise, for the sheet 20 in order to alert the purchaser that the two first colored 68 straps 62 are to be aligned along a side edge 48, 50 of the mattress 12, in order to ensure proper orientation of the fitted sheet 20 on the first try. Instead of color contrast 68, 70, indicia 72, or strap thickness 74, 76 could alternatively be used, although not shown.

Figure 8:
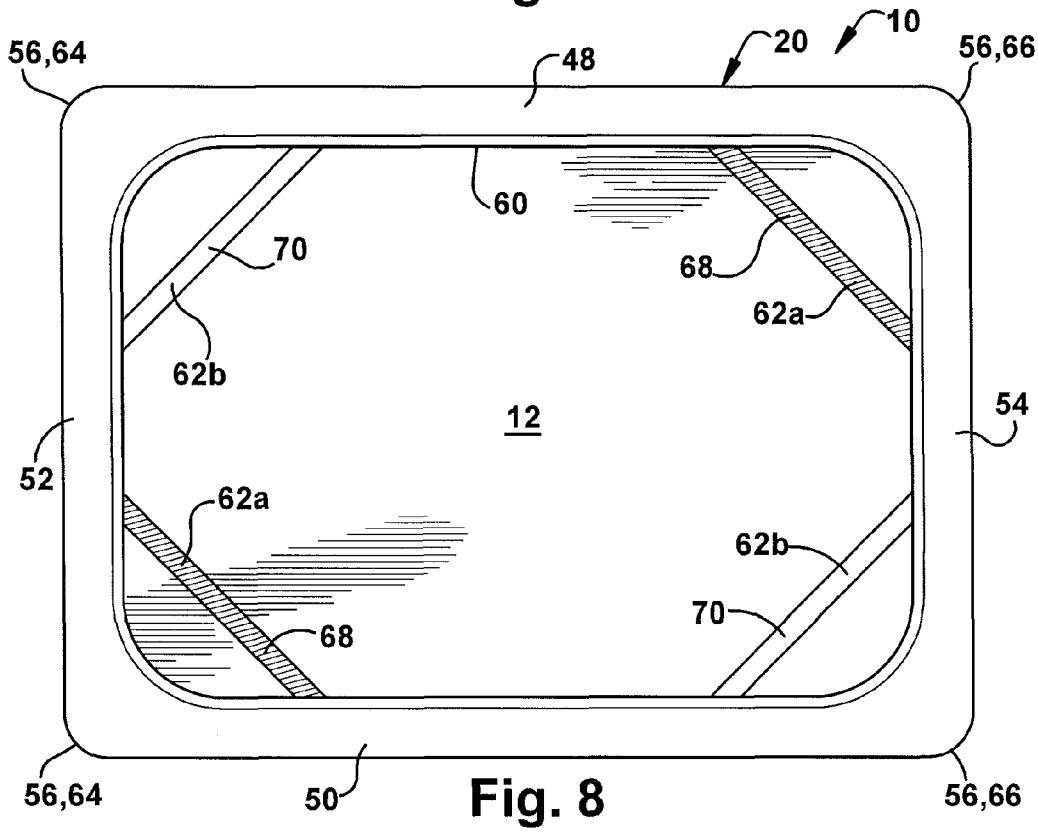
FIG. 8 depicts a bottom view of a bedding system having an alternative example means for orienting the bedding article on a mattress.

FIG. 8 depicts a similar fitted sheet 20 to that shown in FIG. 7, but in this example, opposing corner straps 62*a* have a contrasting first color 68 to the other corner strap 62*b*. Instructions are provided with the packaging for the sheet 20 in order to alert the purchaser that the two first color 68 straps 62*a* are to be positioned at the upper right and bottom left corners of the mattress 12, or vice versa. Direction is determined from looking downwardly from the top of the mattress, so is opposite to that shown in the drawings. Instead of color contrast 68, 70, indicia 72 or thickness 74, 76 of the straps could be used for the two color-contrasting straps, although not shown.

Figure 9:
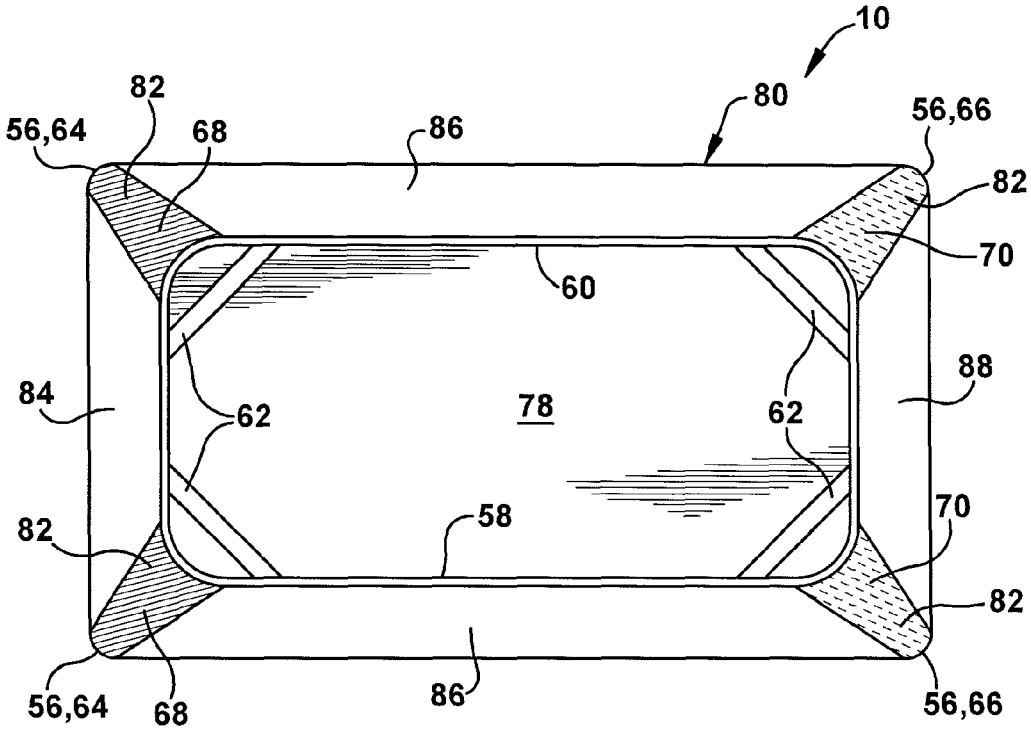
FIG. 9 depicts a bottom view of a bedding system having an alternative example means for orienting the bedding article on a mattress.
Figure 10:
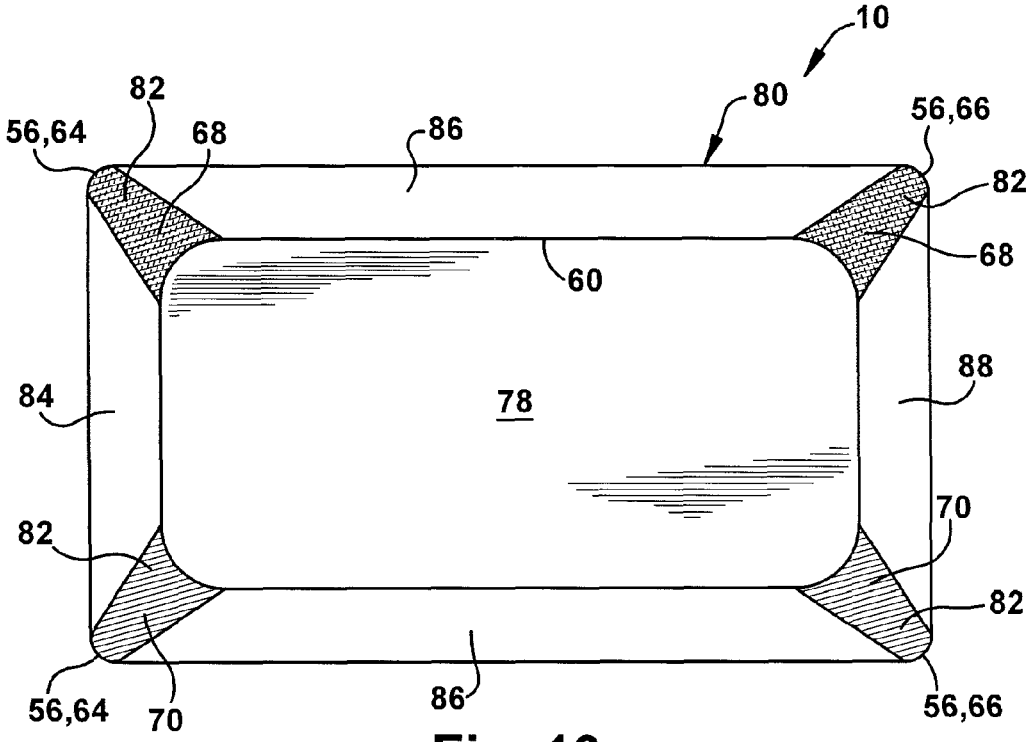
FIG. 10 depicts a bottom view of a bedding system having an alternative example means for orienting the bedding article on a mattress.

FIG. 9 depicts a mattress 78 and cornerless sheet 80. The mattress 78 has a slightly different design because it has corner panels 82 that may or may not be made of an elastic or stretchy material, in order to help to maintain the fitted sheet 80 in place on the mattress 78. The sheet 80 also has elastic corner straps 62, similar to the fitted sheets 20 discussed above. In this example, all the corner straps 62 are the same width, although they could be different widths. In order to distinguish the top end 84 of the sheet 80 from the sides 86, this example utilizes colored corner panels 82 on the sheet 80. Two of the panels 82 have a first color 68 and are shown to be at the top end 84 while contrasting color panels having a second color 70 are at the bottom end 88 of the sheet 20. Alternatively, contrasting panels could be positioned on the sides 86 of the sheet, as shown in FIG. 10, or on opposing corners or a single corner (not shown). Depending upon where the panels 82 with a first color 68 are positioned, the user is provided with instructions to inform the user how to use the panels 82 in orienting the sheet 80 on a mattress 78. The panels 82 are preferably hidden from view under the mattress 12 during use so that the fitted sheet 20 has a uniform appearance to the consumer, although the corner panels 82 could be visible.

Figure 11:
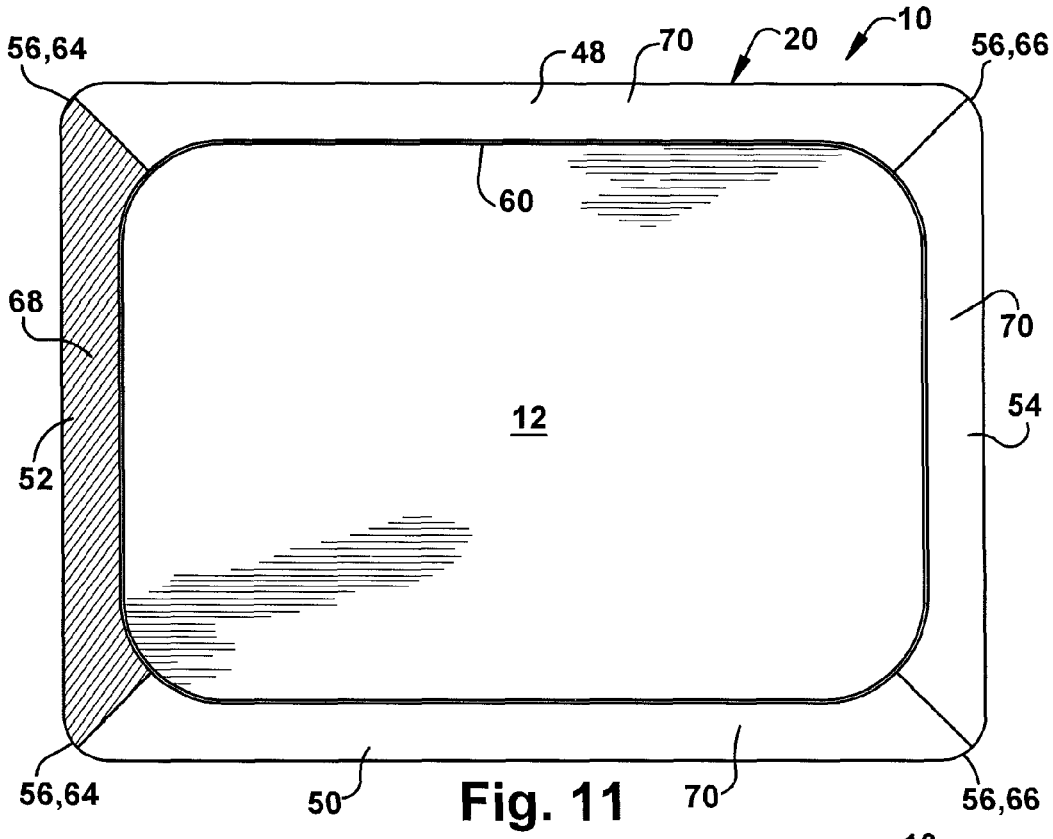
FIG. 11 depicts a bottom view of a bedding system having an alternative example means for orienting the bedding article on a mattress.
Figure 12:
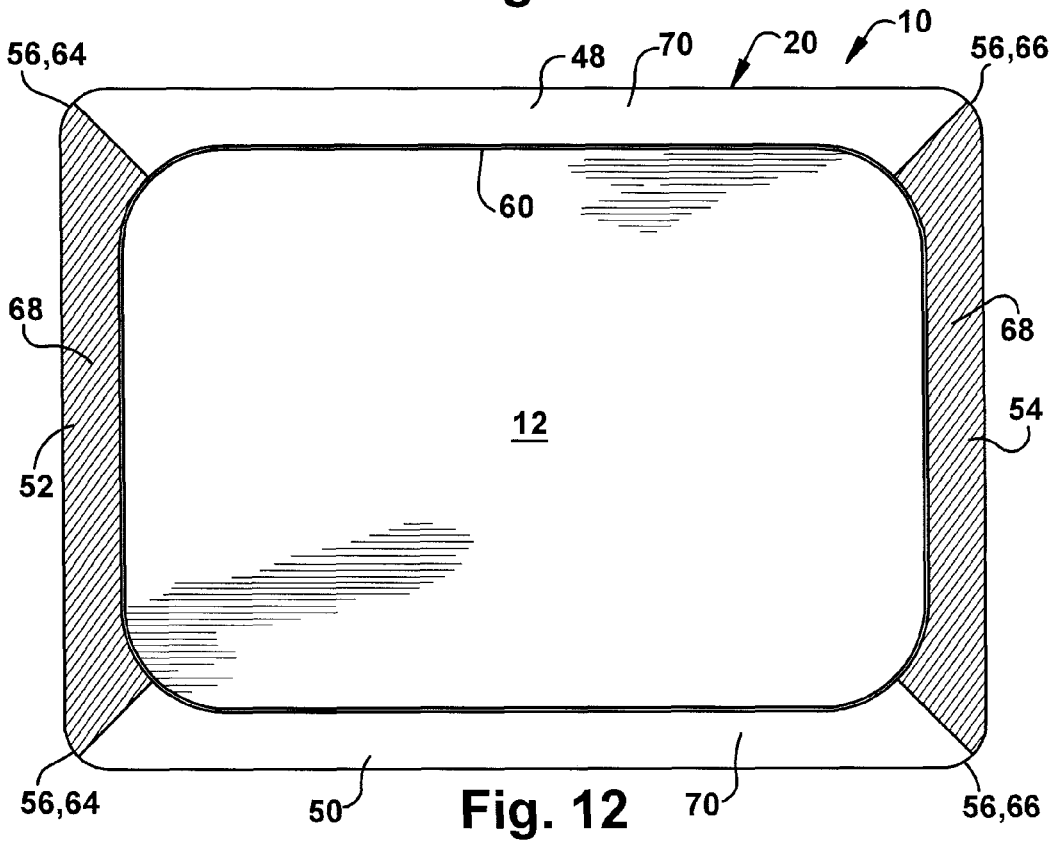
FIG. 12 depicts a bottom view of a bedding system having an alternative example means for orienting the bedding article on a mattress.

FIGS. 11 and 12 depict examples of a fitted sheet 20 where the end panels 52, 54 are used to assist the user in orienting the sheet 20 on a mattress 12 by using color contrast. In FIG. 11, one of the top or bottom end panels 52, 54 is preferably colored a first color 68 while the other end panel is colored a second color 70. In this example, presuming that the fitted sheet 20 can be oriented upside down or right side up, the user is instructed that the first colored 68 panel 52, 54 should be positioned at either the top or bottom end 26, 24 of the mattress 12. If the fitted sheet 20 has a single preferred orientation, then the user is instructed that the first colored 68 panel 54, 56 is to be positioned at either the top or the bottom end 26, 24 of the mattress 12. Preferably, the first colored 68 panel 54, 56 is out of sight once installed on the mattress 12. It may be out of sight under the mattress 12 or out of sight because covered by other bedding 22, 30, 32.

FIG. 12 is similar to FIG. 11, but uses two color contrasted end panels 52, 54 instead of one. In this example, the top and bottom ends 52, 54 of the fitted sheet 20 have a first color 68 that is different from the second color 70 of the two side panels 48, 50. The top and bottom ends 52, 54 of the fitted sheet 20 are positioned on a mattress 12 such that the panels 52, 54 are at the top and bottom of the mattress 26, 24. If the colored panels 52, 54 are the same color as one another, the panels could then be placed at either the top or bottom ends of the mattress 26, 24, if the panels 52, 54 are different colors from one another, then the user would be instructed that the first color 68 end 52 is positioned at the top 26 and the second color 70 end 54 is positioned at the bottom 24. Although not shown, one or both of the side panels 48, 50 could be colored a different color than the end panels 52, 54 to denote a side of the fitted sheet 20, with the end panels 52, 54 having the same or different color from the remainder of the sheet 20. The fitted sheet 20 can be used with corner straps 62, if desired, in any of the examples where corner straps are not shown.

FIGS. 13-17 depict examples where a binding or tape 58 is positioned around the opening 60 of the fitted sheet 20. The binding 58 can encase an elastic material in order to provide stretch to the opening 60. Alternatively, the binding or tape 58 can have a built-in elastic component. The binding or tape 58 may be provided entirely around the edge of the opening 60 of the sheet 20, or can be provided only at certain locations around the edge of the opening 60 of the sheet 20. For example, the binding or tape 58 could be positioned only at the corners 64, 66. The binding or tape 58 can be the same color as the sheet or a different color from the sheet 20. For example, the binding 58 can be white while the sheet 20 is colored. The binding or tape 58 is preferably positioned under the mattress 12 when the fitted sheet 20 is installed on a mattress 12, so that it is out of view once installed. Corner straps 12 may be used in addition to the binding or tape 58. The term "binding" is used hereinafter to refer to either binding or tape or other elastic that may be positioned around the opening 60.

Figure 13:
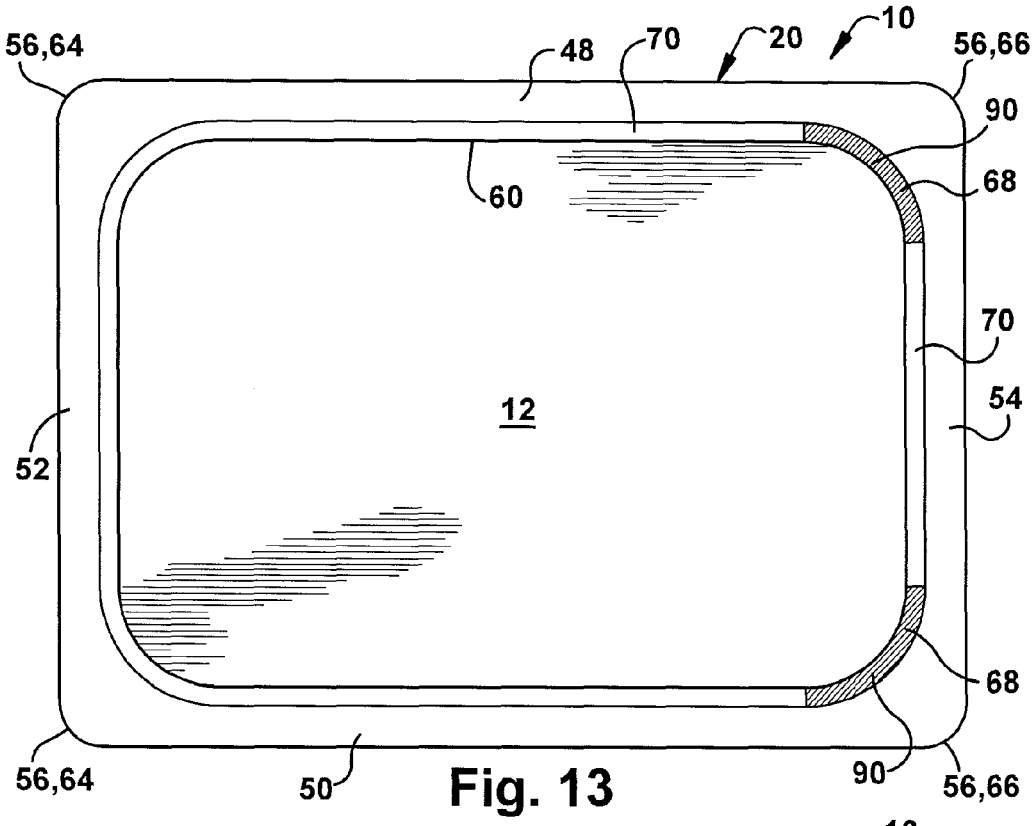
FIG. 13 depicts a bottom view of a bedding system having an alternative example means for orienting the bedding article on a mattress.

FIG. 13 depicts a first example where the binding 58 includes two corner sections 90 that have a contrasting color to the remainder of the binding 58. The two corner sections 90 are positioned at a bottom end 54 of the sheet 20. The corner sections 90 may be formed as separate binding sections that are sewn to the remainder of the binding 58, or could be dyed or otherwise colored sections of the same binding. Alternatively, the colored sections of the binding 58 could be overlaid over another layer of binding that extends around the entire opening 60. Other ways to color contrast the two corner sections 90 may also be utilized, as known by those of skill in the art. With this example, the user is instructed that the two color contrasted corner sections 90 are to be positioned at a bottom end 54 of the mattress 12. Alternatively, if it doesn't matter which end is up and down, the user is instructed that the two color contrasted corner sections 90 should either be positioned at the top end 26 or at the bottom end 24 of the mattress 12. Instead of color contrast 68, 70, indicia 72 or other surface treatments could be utilized to distinguish the corner sections 90.

Figure 14:
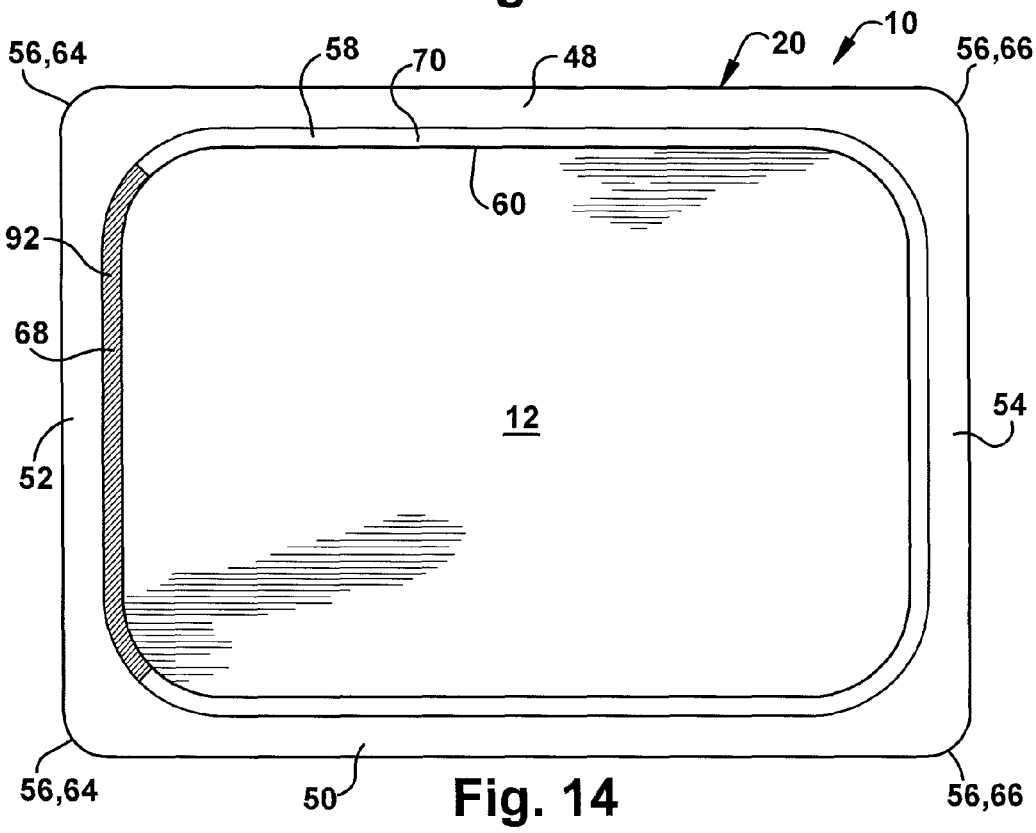
FIG. 14 depicts a bottom view of a bedding system having an alternative example means for orienting the bedding article on a mattress.

FIG. 14 is similar to FIG. 13, but utilizes a continuous section of color contrasted binding 92 at the top end 52 of the fitted sheet 20. The color contrasted section 92 may be formed as a separate binding section that is sewn to the remainder of the binding 58, or could be dyed or otherwise colored, from a binding 58 that extends around the entire opening 60 of the sheet 20. Alternatively, the colored section of the binding 92 could be overlaid over another layer of binding 58 that extends around the entire opening 60. Other ways to color contrast the section 92 may also be utilized, as known by those of skill in the art. With this example, the user is instructed that the color contrasted section 92 is to be positioned at a top end 26 of the mattress 12. Alternatively, if it doesn't matter which end is up or down, the user is instructed that the color contrasted section 92 should either be positioned at the top end 26 or the bottom end 24 of the mattress 12. Instead of color contrast 68, 70, indicia 72 or other surface treatments could be utilized to distinguish the end sections 52, 54.

Figure 15:
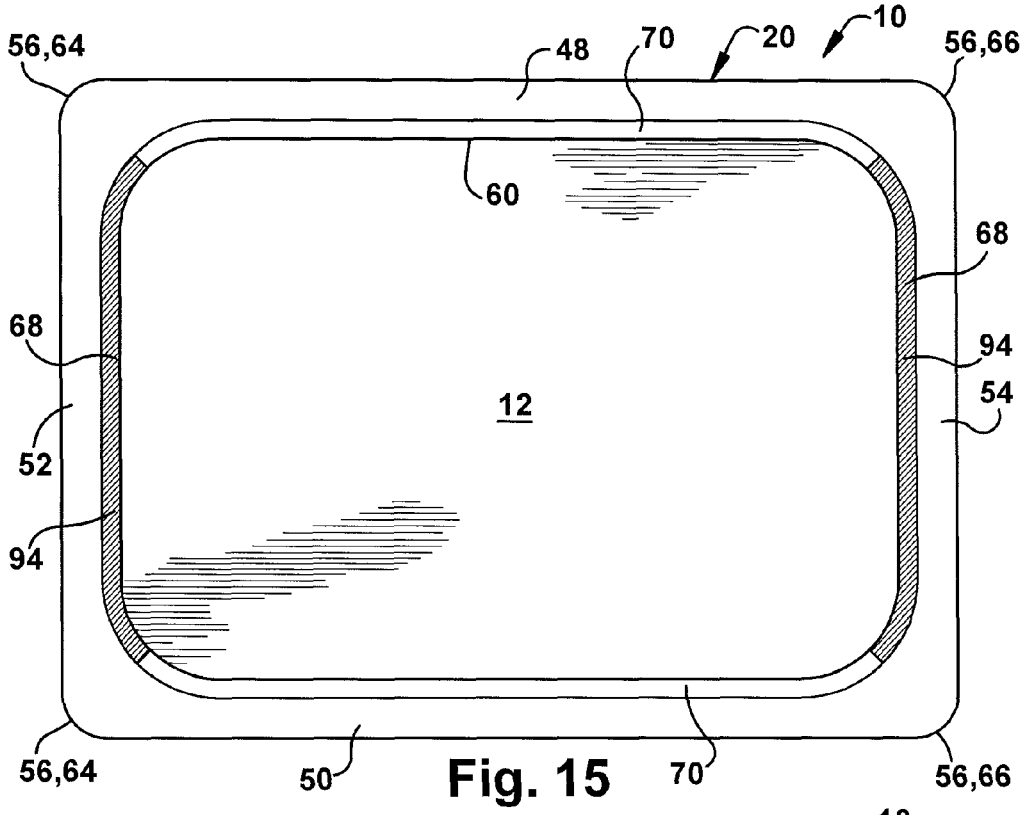
FIG. 15 depicts a bottom view of a bedding system having an alternative example means for orienting the bedding article on a mattress.
Figure 16:
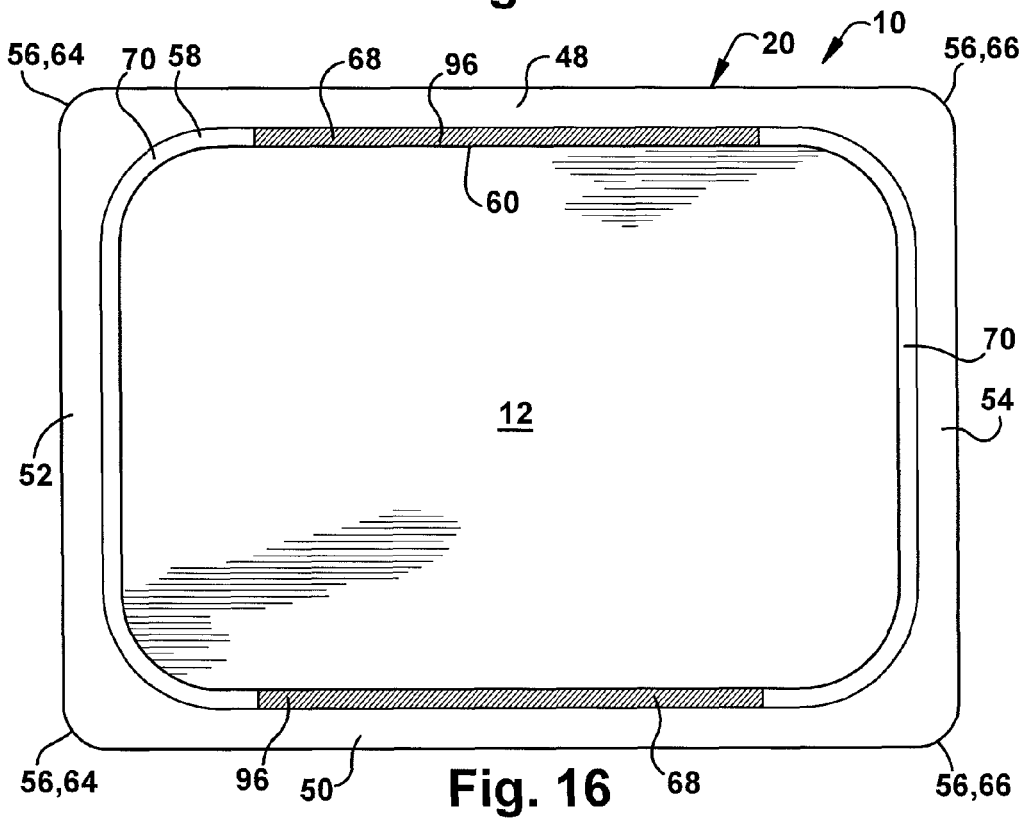
FIG. 16 depicts a bottom view of a bedding system having an alternative example means for orienting the bedding article on a mattress.

FIG. 15 is similar to FIG. 14, but instead of using a single color-contrasted end section 92, it utilizes two end sections 94 that are color contrasted—namely, at a top end 52 and a bottom end 54 of the fitted sheet 20. The color contrasted sections 94 may be formed as separate binding sections that are sewn to the remainder of the binding 58, or could be dyed or otherwise colored from a binding that extends around the entire opening 60 of the sheet 20. Alternatively, the colored sections of the binding 94 could be overlaid over another layer of binding 58 that extends around the entire opening 60. Other ways to color contrast the sections may also be utilized, as known by those of skill in the art. With this example, the user is instructed that the color contrasted sections 94 should be positioned at a top end 26 and a bottom end 24 of the mattress 12. Instead of color contrast 68, 70, indicia 72 or other treatments could be utilized to distinguish the color-contrasted sections. While the colored sections 94 are shown extending across most of the width of the binding 58 at the ends 52, 54 of the fitted sheet 20, the color contrasted binding area 94 could be made much smaller or larger (not shown). For example, a small section (not shown) of one or more inches could be centered at the ends 52, 54 to denote the top and bottom ends of the fitted sheet 20. FIG. 16 utilizes the same concepts, but instead of having the color contrasted segments 94 at the top and bottom, it utilizes color contrasted sections 96 on the sides 48, 50. Appropriate user instructions would be provided to tell the user that the colored side sections 96 are to be positioned to extend parallel to the sides 28 of the mattress 12. Instead of color contrast 68,70, indicia 72 or other treatments could be utilized to distinguish the side sections 48, 50. In both examples, the colored sections 96 are hidden from view when the sheet 20 is installed on a mattress 12.

Figure 17:
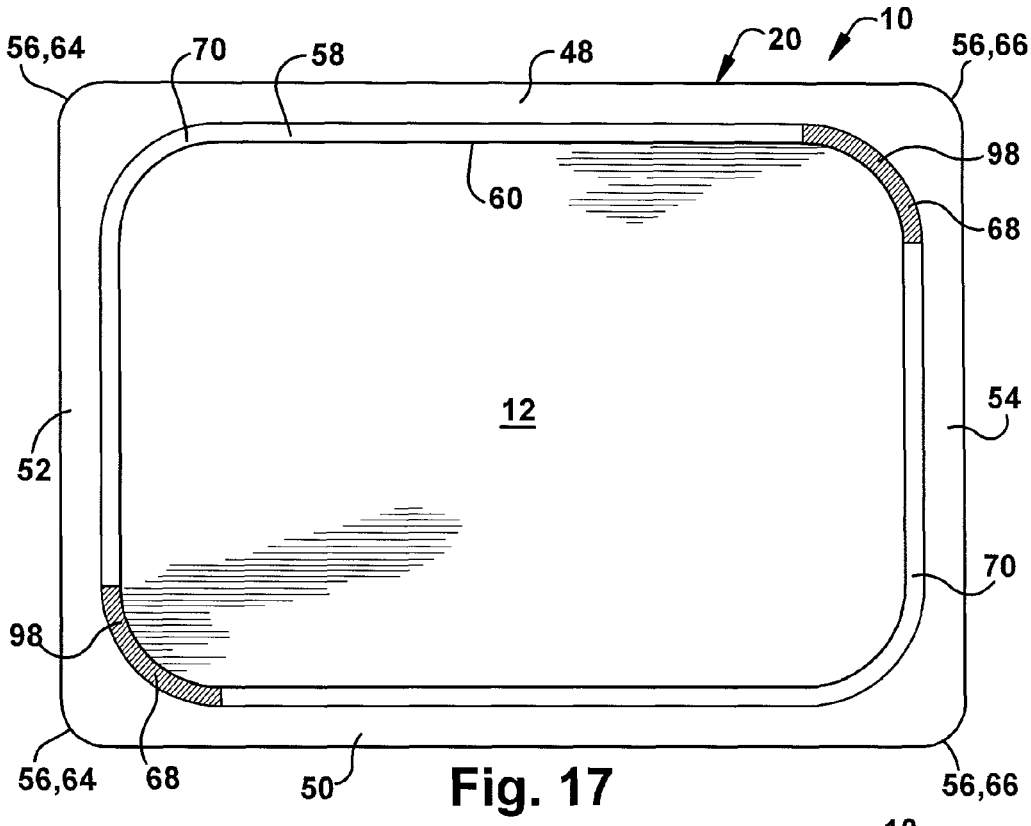
FIG. 17 depicts a bottom view of a bedding system having an alternative example means for orienting the bedding article on a mattress.

FIG. 17 is similar to FIGS. 13-16, but utilizes color contrasted sections 98 at opposing corners. One corner section 98 is positioned at a bottom end of the sheet 20 and one corner section 98 is positioned at a top end of the sheet 20. The corner sections 98 may be formed as separate binding sections that are sewn to the remainder of the binding 58, or could be dyed or otherwise colored sections of the same binding. Alternatively, the colored sections of the binding 98 could be overlaid over another layer of binding 58 that extends around the entire opening 60. Other ways to color contrast the two corners 98 may also be utilized, as known by those of skill in the art. With this example, the user would be instructed that the two color contrasted corners 98 are to be positioned at the upper right corner and lower left corners of the mattress 12. Instead of color contrast 68, 70, indicia 72 or other treatments could be utilized to distinguish the side sections 48, 50.

Figure 18:
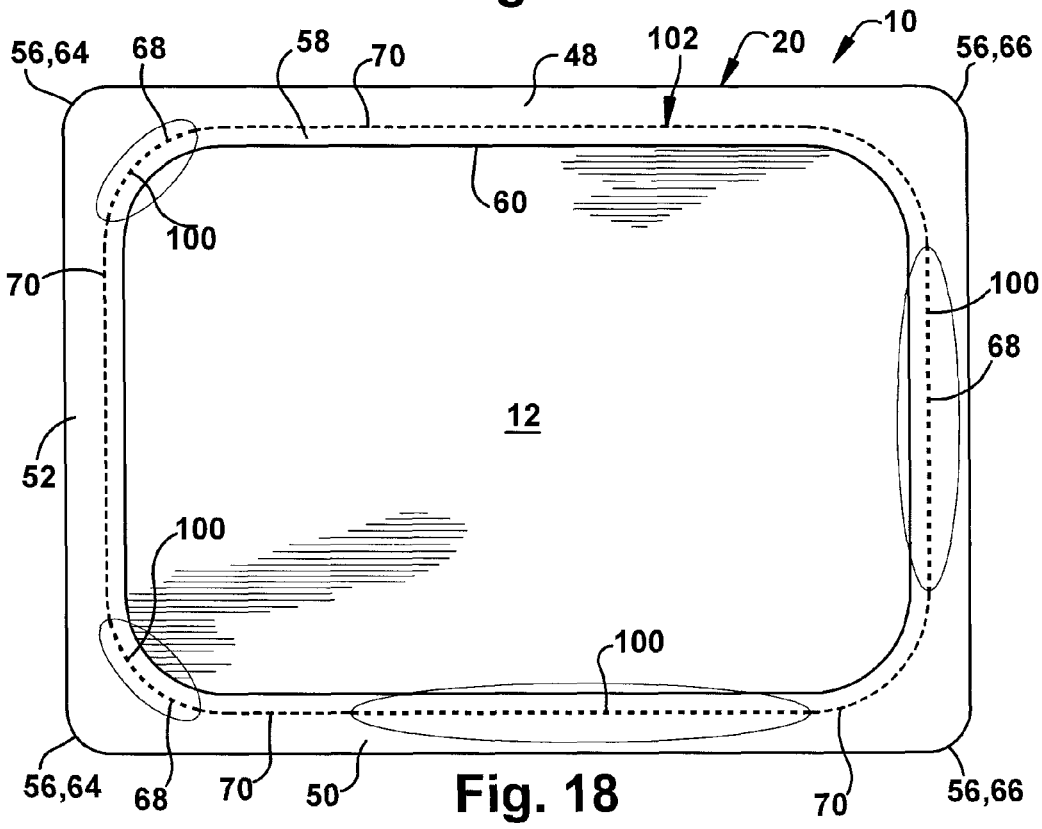
FIG. 18 depicts a bottom view of a bedding system having an alternative example means for orienting the bedding article on a mattress.
Figure 19:
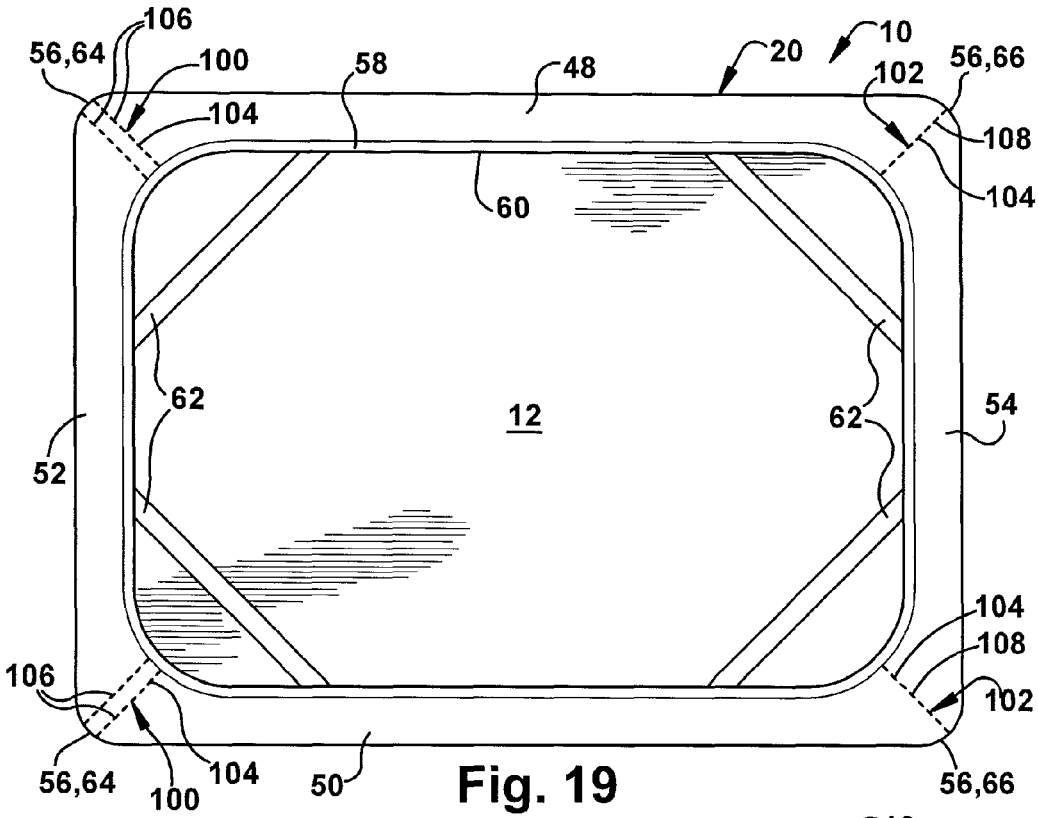
FIG. 19 depicts a bottom view of a bedding system having an alternative example means for orienting the bedding article on a mattress.
Figure 20:
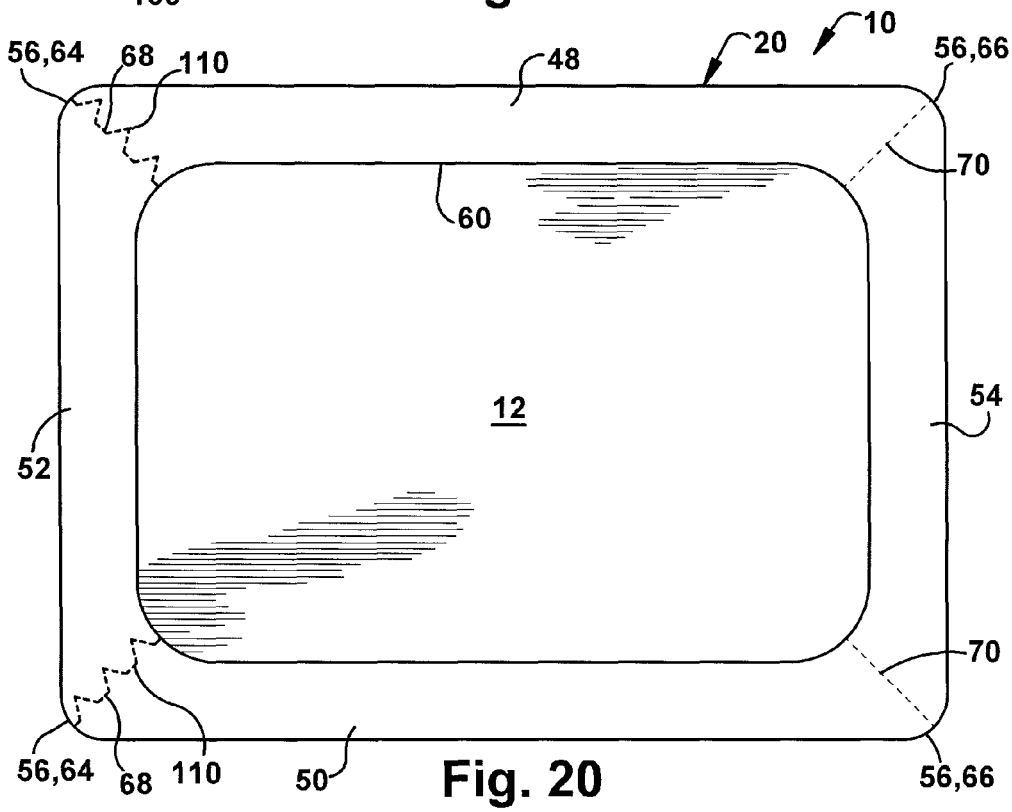
FIG. 20 depicts a bottom view of a bedding system having an alternative example means for orienting the bedding article on a mattress.

FIGS. 18-20 present different examples where stitching 100 is used to orient the bedding article on a mattress 12. FIG. 18 shows several different examples where different colored stitching 100 is used to aid in orienting the sheet 20 on a mattress 12. Circled areas around the opening 60 of the sheet 20 identify possible areas where different colored stitching 100 could be utilized to assist in orienting the bedding article properly. All of these areas have been discussed above in connection with the colored binding sections 90, 92, 94, 96, 98 and include the top or bottom corners 64, 66, the top or bottom ends 52, 54, or the sides 48, 50 of the opening 60 to the fitted sheet 20. In the example shown, the opening 60 of the sheet 20 is trimmed in a stitched binding 58. For example, an elastic cord could be positioned between a stitched pocket of fabric in order to encase the elastic cord. The stitching 100 at one or more of the highlighted sections has a first color 68 that is different from the remainder of the stitching 102 around the opening 60 in order to distinguish that section of the stitching 100.

FIG. 19 depicts a bedding article that has corner seams 104 adjacent the corners 56 of the opening 60 of the bedding article. A binding 58 is positioned entirely around the opening 60, and corner straps 62 are utilized. In this example, two of the four corner seams 104 have two lines of stitching 106 while the other two corner seams 104 have only a single line of stitching 108. The user would be instructed that the corner seams 104 having two lines of stitching 106 should be positioned at the top 26 and/or bottom 28 of the mattress 12 for proper orientation. As shown above with other examples, this double stitching 106 could be used at other locations on the sheet 20 to assist in orientation. For example, a double row of stitching 106 could be used adjacent the binding 58 at the corners 56 along one of the side 48, 50 or end 54, 56 binding seams, the invention not being limited to a particular location for the stitching 100, 106. In addition to or in place of the double line of stitching 106, color contrast 68, 70 could be used in the stitching to denote an end 52, 54 or side 48, 50 of the bedding article.

FIG. 20 is similar to FIG. 19, but instead of using two lines of stitching 106 to assist in orientation, it utilizes a different stitching pattern 110 at two of the corners. Alternatively, or in addition to the stitching pattern, thicker stitches or colored stitches could be used. The stitching could be positioned at other locations, as well, to assist in denoting the ends 52, 54 or sides 48, 50 of the sheet 20. For example, different stitching 110 could be utilized around the binding 58.

Figure 21:
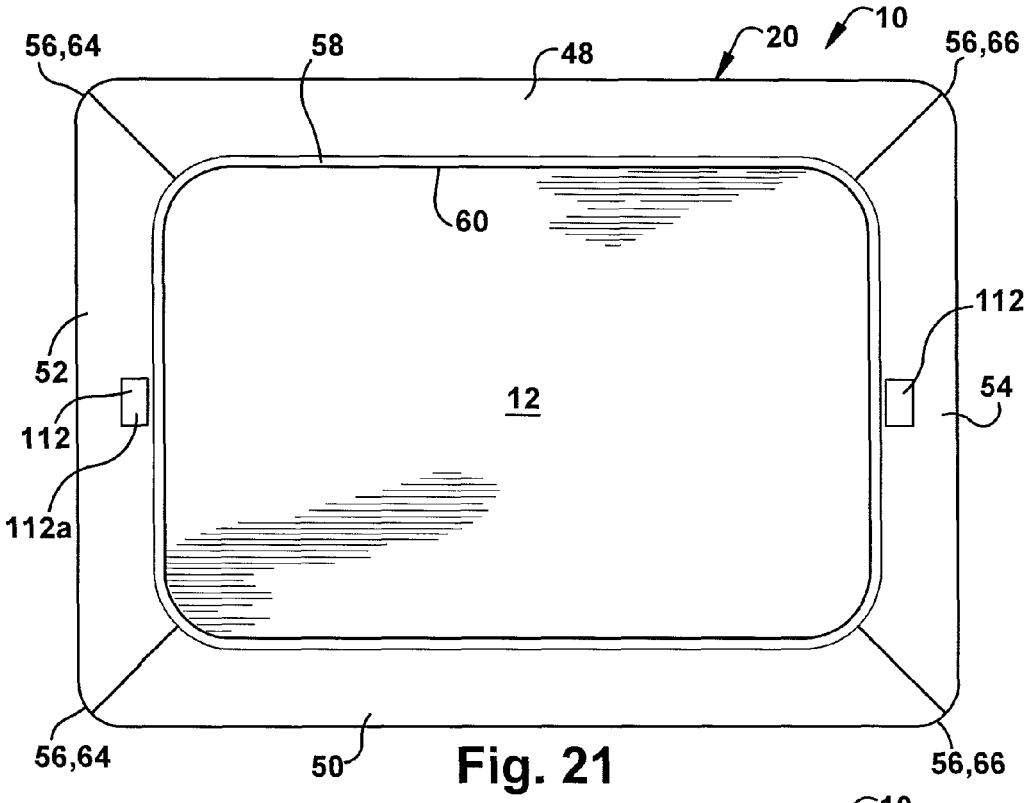
FIG. 21 depicts a bottom view of a bedding system having an alternative example means for orienting the bedding article on a mattress.

FIGS. 21-25 depict various examples that utilize labels to orient the bedding article on a mattress 12. FIG. 21 depicts a fitted sheet 20 that has an elastic binding 58 around the opening 60. Two labels 112 are positioned on the sheet 20. A first label 112*a* is positioned at a top end 52 of the sheet 20 and a second label 112*b* is positioned at a bottom end 54 of the sheet 20. In this example, the labels 112 are centered along the top and bottom edges 52, 54 of the sheet 20. The labels 112*a*, 112*b* are not visible when the fitted sheet 20 is installed on the mattress 12 because they are positioned between the mattress 12 and box spring 14, or otherwise facing downwardly out of sight. The labels 112*a*, 112*b* may be affixed to the fitted sheet 20 in any known manner. For instance, the labels 112*a*, 112*b* may be affixed with an adhesive, transferred, or sewn onto the fitted sheet 20. They could be sewn into or on the binding 58, or extend from one of the binding seams. The labels 112*a*, 112*b* may be plain (meaning no indicia) or could have indicia 72 in the form of written instructions or symbols or drawings for a user. One example where written instructions would be helpful is if the fitted sheet 20 has only one preferred orientation. In this case, one of the labels 112*a*, 112*b* could state "TOP END" and the other label 112*a*, 112*b* could state "BOTTOM END." The labels 112*a*, 112*b* could be attached as tags, where only one side of the tag is fastened to the fitted sheet 20. The labels 112*a*, 112*b* may be the same color as the fitted sheet 20 or binding 58, or may be a contrasting color from the fitted sheet 20 and/or binding 58.

Figure 22:
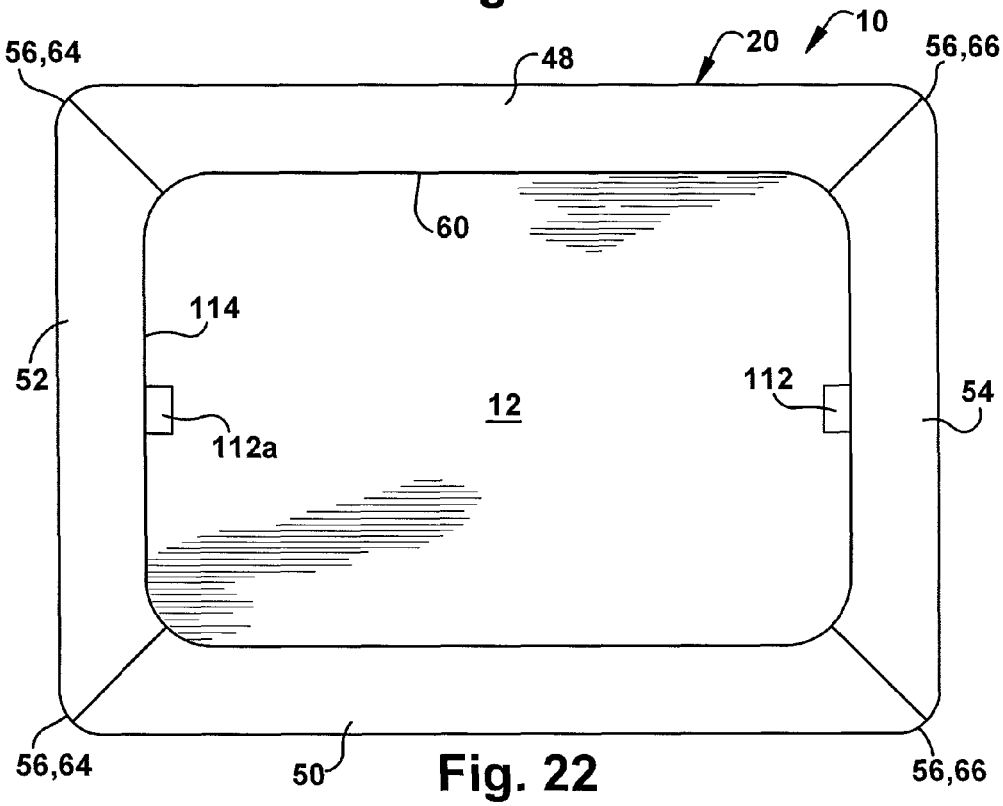
FIG. 22 depicts a bottom view of a bedding system having an alternative example means for orienting the bedding article on a mattress.

FIG. 22 depicts another example orientation means where two labels 112*a*, 112*b* are again provided on the fitted sheet 20. In this example, the labels 112*a*, 112*b* are tags that are sewn or otherwise attached to the edge of the opening 60. The sheet 20 may have a binding 58 around the opening 60, if desired, but not shown. In addition, the sheet 20 could have corner straps 62 (not shown), if desired. The tags 112*a*, 112*b* are fastened to the sheet 20 such that they extend into the sheet opening 60. The tags 112*a*, 112*b* may be folded under the opening 60 when the sheet 20 is installed on a mattress 12, if desired. As with the example in FIG. 21, the labels 112*a*, 112*b* are not visible when the fitted sheet 20 is installed on a mattress 12. The labels 112*a*, 112*b* are shown positioned at the center of each end 52, 54 of the opening 60 of the fitted sheet 20. The labels 112*a*, 112*b* may be affixed to the fitted sheet 20 in any known manner. For instance, the labels 112*a*, 112*b* may be affixed with an adhesive, transferred, or sewn onto the fitted sheet 20. They may be sewn into or on the binding 58, or extend from one of the binding seams. The labels 112*a*, 112*b* may be plain (meaning no indicia) or could have indicia 72 in the form of written instructions or symbols or drawings for a user. For example, the labels 112*a*, 112*b* could say "TOP END," "BOTTOM END", "TOP OR BOTTOM END," "TOP," "BOTTOM," or the like. The labels 112*a*, 112*b* can be the same color as the fitted sheet 20 or binding 58, or can be a contrasting color from the fitted sheet 20 or binding 58.

Figure 23:
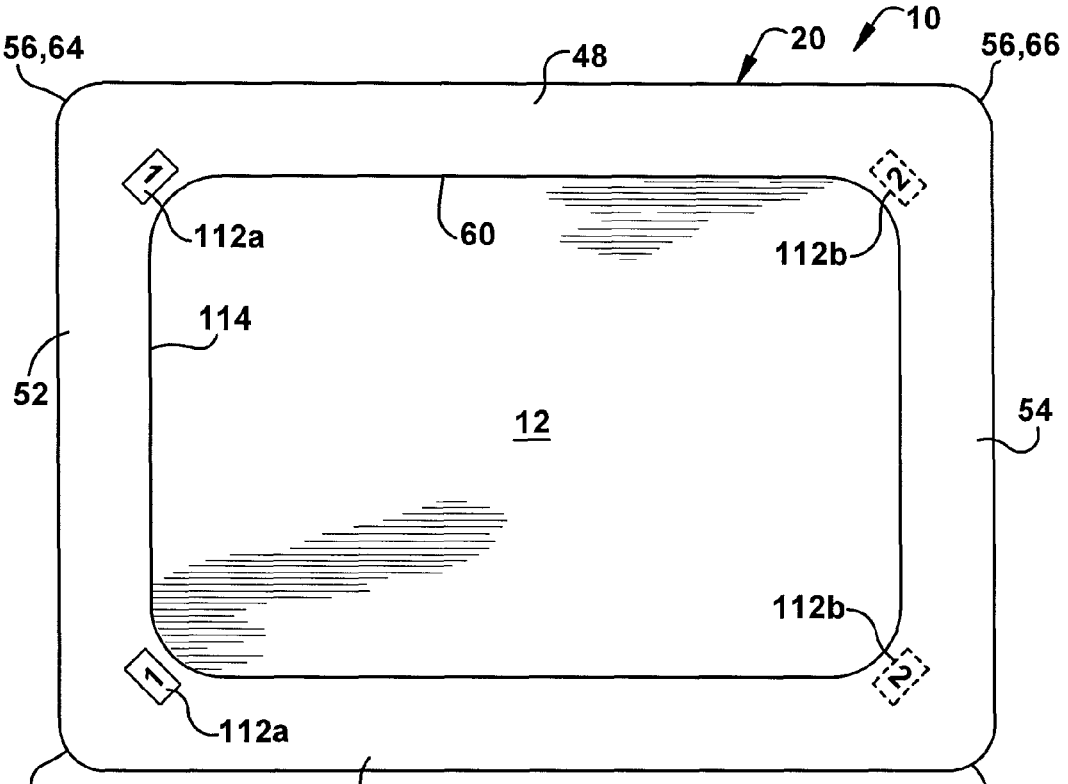
FIG. 23 depicts a bottom view of a bedding system having an alternative example means for orienting the bedding article on a mattress.

FIG. 23 depicts two additional examples of a means for orienting the fitted sheet. Two of the labels 112*a*, denoted with the number 1, are shown positioned at a top end 52 of the fitted sheet 20 in the corners 64 thereof. This is similar to the color contrast examples discussed above in FIG. 2, with color coded straps 62. Instead of using color contrasting straps 62, this example uses two labels 112*a*, one on each corner 64 of the fitted sheet 20. User instructions are provided to the user to instruct them that the labels 112*a* signify the top or bottom 52, 54 of the fitted sheet 20. Where the sheet 20 is to be oriented in only a single direction, the user is instructed that the labels 112*a* are supposed to be positioned at a top end 26 of the mattress 12, or a bottom end 24 of the mattress 12 (as signified by the dashed-lined labels 112*b* with the number 2). An alternative embodiment involves including four labels 112*a*, 112*b* on the fitted sheet 20—with two labels 112*a* (numbered 1 in FIG. 23) at the top end 26 and two labels 112*b* (numbered 2 in FIG. 23) at the bottom end 24. In one example, the labels 112*a* have a first color 68 and the labels 112*b* have a second color 70 in order to denote the top 52 from the bottom 54. Alternatively, the labels 112*a*, 112*b* could have indicia 72 on them, such as the words "TOP" or "BOTTOM." In all of these examples, the labels 112*a*, 112*b* are hidden from view when the fitted sheet 20 is installed on a mattress 12. As discussed above, the labels 112*a*, 112*b* can be affixed in any known manner.

Figure 24:
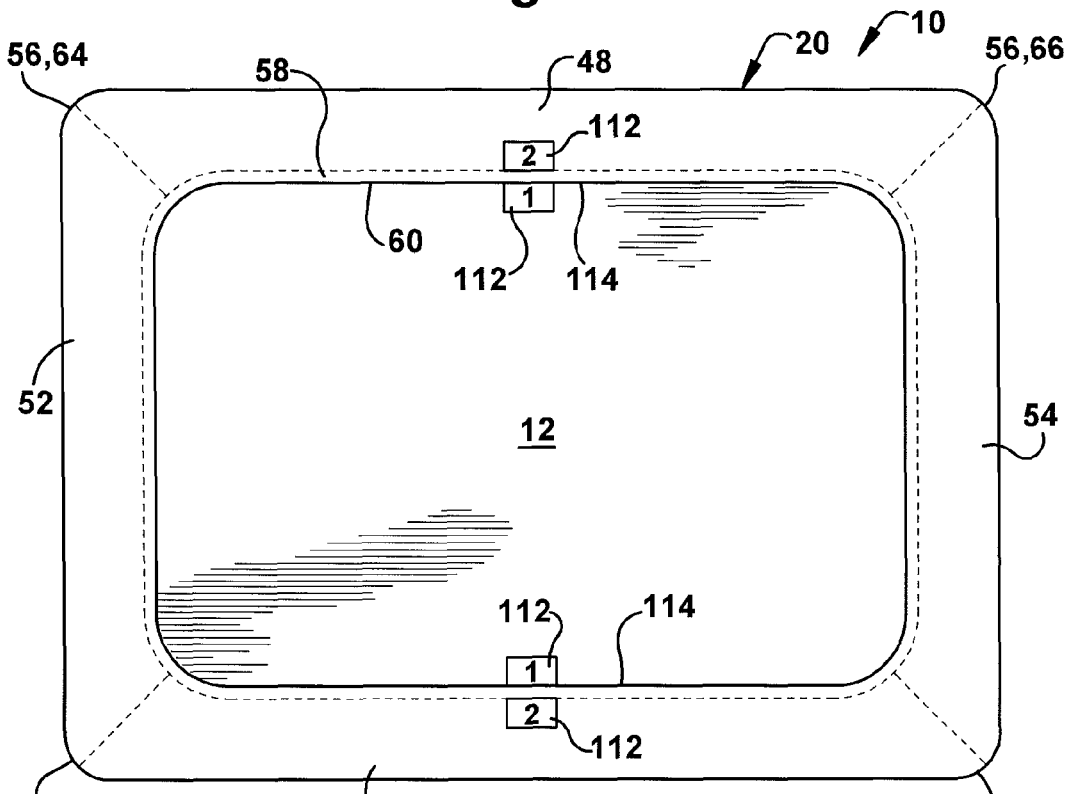
FIG. 24 depicts a bottom view of a bedding system having an alternative example means for orienting the bedding article on a mattress.

FIG. 24 depicts two additional examples of a means for orienting the fitted sheet 20 on a mattress 12. A first example is labeled with the number 1 and a second example is labeled with the number 2. The first example includes tags 112*a* that are sewn or otherwise attached to the inner edge 114 of the sheet opening 60 such that the tags 112*a* extend inwardly. These tags 112*a* may be folded under the sheet 20 when the sheet 20 is installed on a mattress 12 so that they are not visible. The tags 112*a* are positioned in order to identify the center, sides 48, 50 of the fitted sheet 20 and are positioned in the center of the fitted sheet opening 60, one on each side 48, 50. The tags 112*a* may be attached to the binding 58 around the opening 60 or attached to the fabric of the sheet 20. The second example shows labels 112*b* that are sewn directly to the fitted sheet 20, as shown by the labels 112*b* numbered "2". These tags 112*b* are not foldable under the fitted sheet 20. They are positioned on a side wall 48, 50 of the fitted sheet 20 and centered in order to denote the center/side of the fitted sheet 20. They may be attached in any known manner. Both types of labels 112*a*, 112*b* may include indicia 72, if desired, or be color coded 68, 70, with appropriate user instructions to inform the user of how the fitted sheet 20 is to be installed on a mattress 12. In both examples, the labels 112*a*, 112*b* are hidden from view when installed on the mattress 12.

Figure 25:
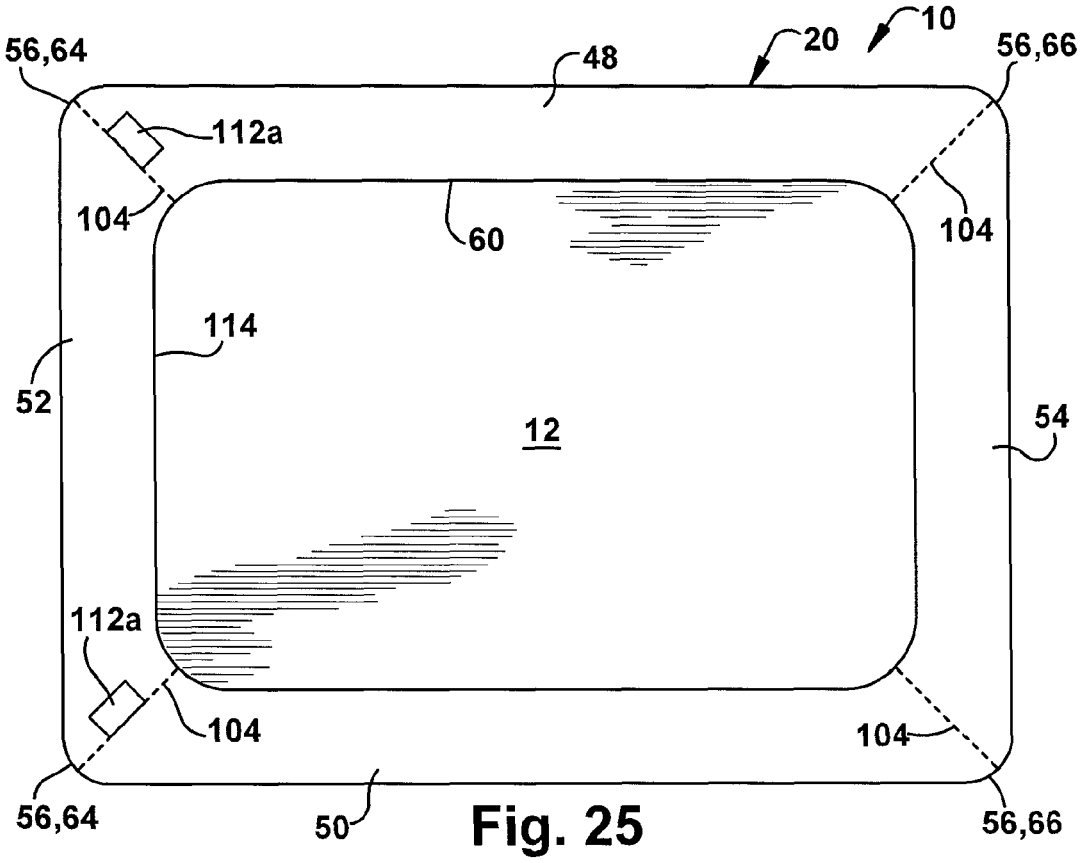
FIG. 25 depicts a bottom view of a bedding system having an alternative example means for orienting the bedding article on a mattress.

FIG. 25 is another example showing how labels 112 can be sewn into the corner seams 104 of a fitted sheet 20. The labels 112 may be attached along the seam line so that they are similar to tags, or may be sewn along one side at the seam and on the other three sides along the edges of the label 112 so as to not operate as a tag. The labels 112 may be the same color as the fitted sheet 70 or a different color 68. The user is provided with instructions telling the user how to orient the sheet 20 on a mattress 12 based upon the location of the labels 112. For instance, a user is told that the two labels 112 are to be positioned at either a bottom 24 or a top end 26 of the mattress 12. The labels 112 may include indicia 72, if desired. These labels 112, and any of the above-described labels 112 may be made of a material that is the same as, or different from the material of the fitted sheet 20.

Figure 26:
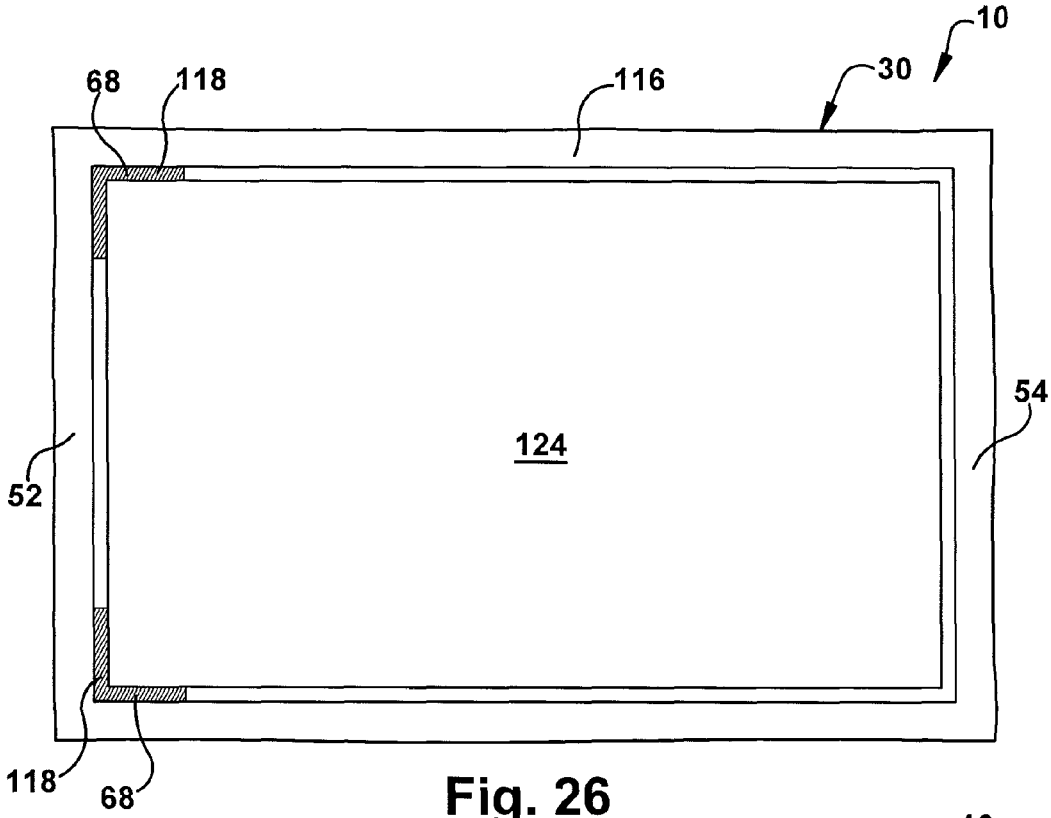
FIG. 26 depicts a bottom view of a flat bedding article, such as a blanket, flat sheet, or comforter having an example means for orienting the bedding article on a mattress.
Figure 27:
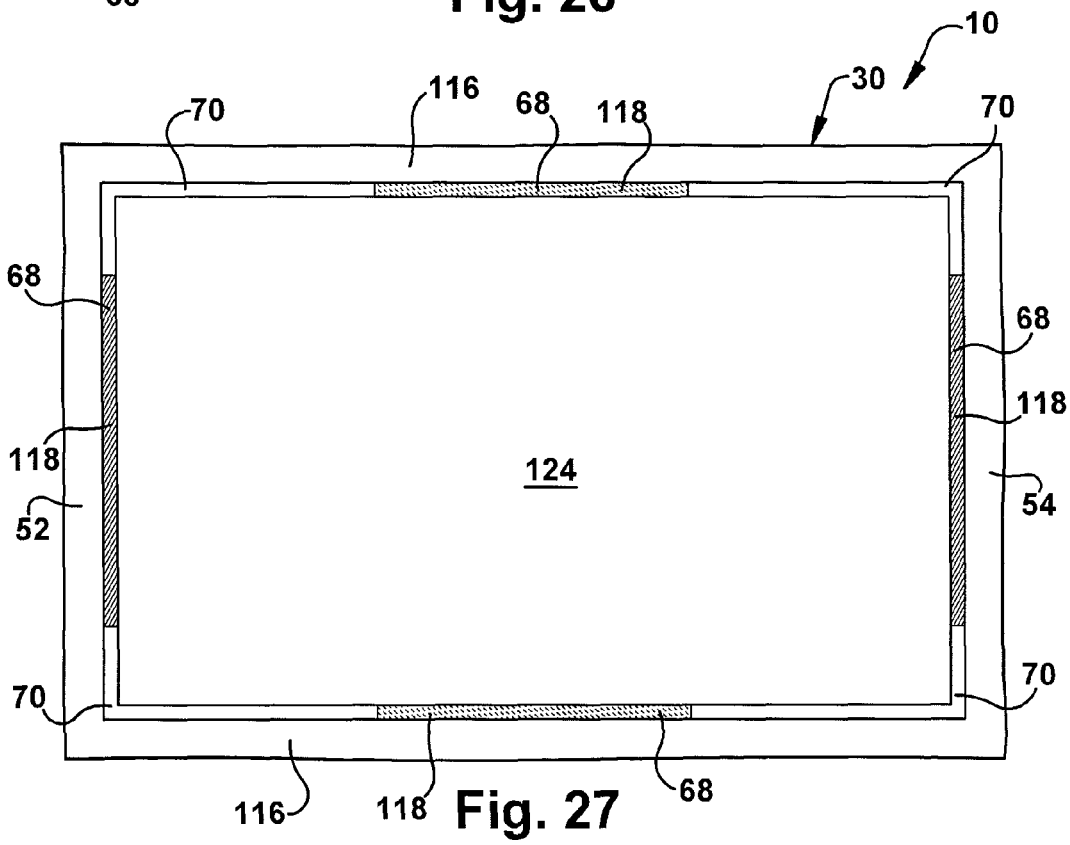
FIG. 27 depicts a bottom view of a flat bedding article, such as a blanket, flat sheet, or comforter having several alternative example means for orienting the bedding article on a mattress.

FIGS. 26-31 depict various alternative examples of bedding articles and covers that utilize the teachings of the present application. FIGS. 26-29 disclose various embodiments of the underside of bedding that utilize the teachings above. For example, FIGS. 26-27 depict a blanket 30, comforter 32, or flat sheet 22 that has a border 116 sewn in the vicinity of an outer edge of the bedding article. Part of the border 116 has a colored section 118 that has a first color 68 while the remainder of the border has a second color 70. FIG. 26 depicts two corners 64 at a top end 52 of the blanket 30 that have color contrasting border sections 118. The user may be instructed that the colored corner sections 118 are to be positioned at either the top or bottom end 26, 24 of the mattress 12. The colored border sections 118 may be provided in any known manner. For example, separate pieces of color contrasting fabric can be sewn to the bedding, or parts of the bedding could be colored or dyed. Tape could be applied by sewing or otherwise coupled to the bedding. Lines could be painted on. Any known way for applying a section with color contrast may be utilized. The color contrasting section 118 is not visible when the bedding is positioned on a mattress 12. Instead of color contrast, fabrics with contrasting textures could be used, along with matching colors, although unmatching colors may also be used.

FIG. 27 is an example like FIG. 26, but in this example, color contrasting sections 118 are provided along the top and bottom edges 52, 54 and along the side edges 48, 50. These examples may be used together or alone. For example, the bedding material may use a single line of color contrasting material 118 at one end of the blanket 30 to denote the top or bottom 24, 26 of the mattress 12. Color contrasting sections 118 at the top and bottom 52, 54 can be used to tell the user that one represents the top of the mattress 26 and the other represents the bottom of the mattress 24. In cases where the bedding can be oriented with either end up or down, the user can simply be instructed that one of the color contrasting sections 118 has to be positioned at either the top or the bottom 26, 24 of the mattress 12. If the top of the blanket 30 can be positioned at only one end, then one of the color contrasting stripes 118*a* can be one color 68 and the other 118*b* another color 70, or a single stripe can be used. The same is true for color contrasting sections 118 along the sides 48, 50 of the bedding material. The color contrasting sections 118 can be used together, or alone. Where side sections 48, 50 are used, top and bottom sections may not be required and, thus, can be absent. A single side section 48, 50 can be used as long as a user is informed that the color contrasting section 118 of the bedding material is to be positioned along one side 28 of the mattress 12. Instead of contrasting colors, contrasting textures, labels, stitching, or any of the above described means for orienting may be used. Appropriate user instructions are helpful.

Figure 28:
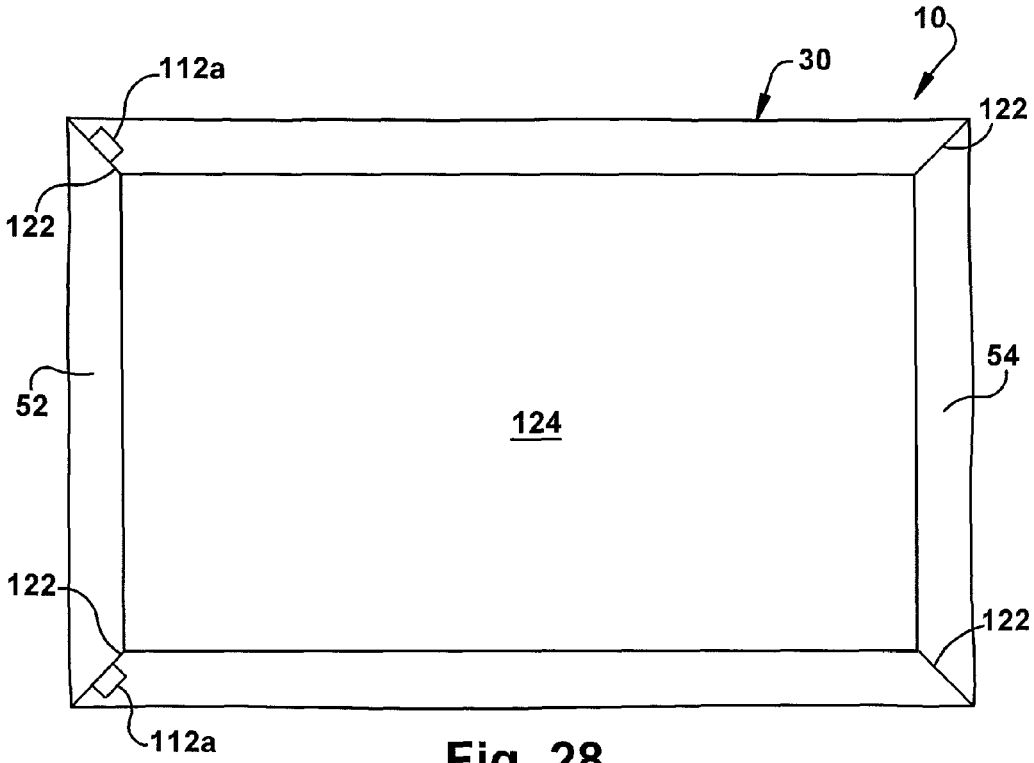
FIG. 28 depicts a bottom view of a flat bedding article, such as a blanket, flat sheet, or comforter having an alternative example means for orienting the bedding article on a mattress.

FIG. 28 depicts an example where the bedding article is oriented using labels 112. In this case, a blanket 30 has an edge 120 that is trimmed. An example of this kind of blanket 30 is one that is trimmed in a soft, satin material. In this example, the labels 112 are sewn into the corner seams 122 on a bottom side 124 of the bedding material 30, as discussed above in connection with FIG. 25. The labels 112 are not visible to the user once the blanket 30 is installed. The labels 112 may be affixed in any known manner, as discussed above.

Figure 29:
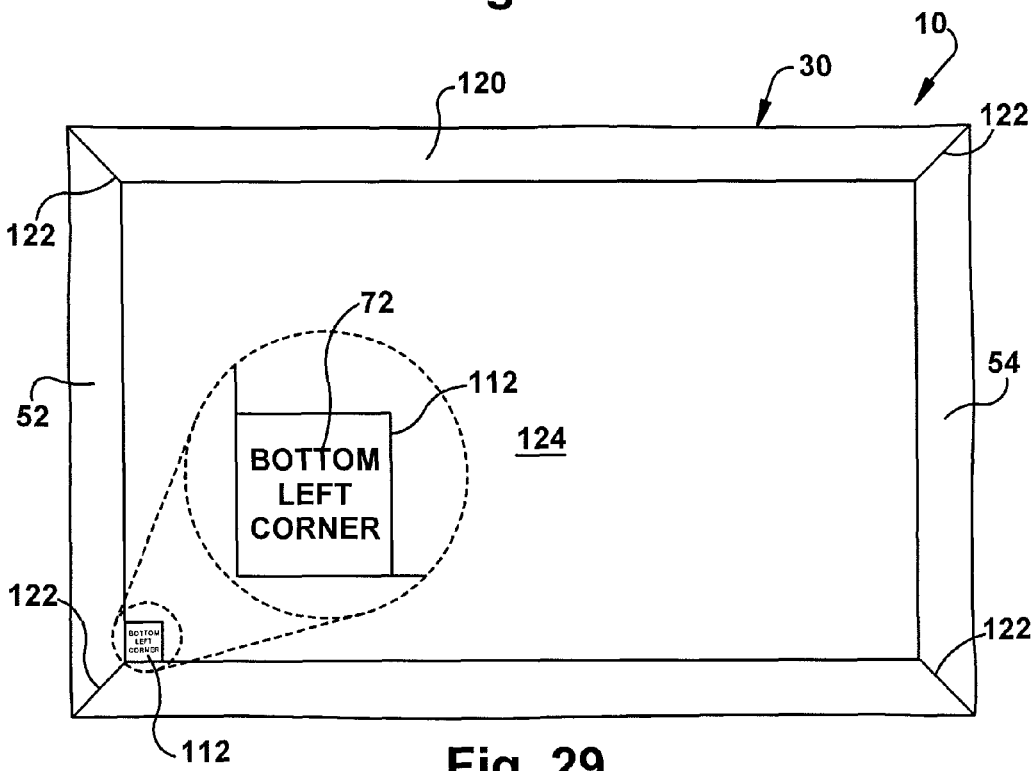
FIG. 29 depicts a bottom view of a flat bedding article, such as a blanket, flat sheet, or comforter having an alternative example means for orienting the bedding article on a mattress.

FIG. 29 is an alternative example where a single label 112 is affixed to the bottom side 124 of the bedding material 30. The label 112 may be affixed in any known manner, as discussed above. For example, the label may be sewn into the seams of the blanket, affixed with an adhesive, transferred on with heat, painted or drawn on, or otherwise coupled to the bottom side 124 of the blanket 30. In this case, 112 the label is affixed to only one corner of the blanket 30. It may be provided with indicia 72, such as "BOTTOM LEFT CORNER." Alternatively, instructions may be provided with the packaging for the bedding in order to inform the user how to properly orient the blanket 30 on a mattress 12.

Figure 30:
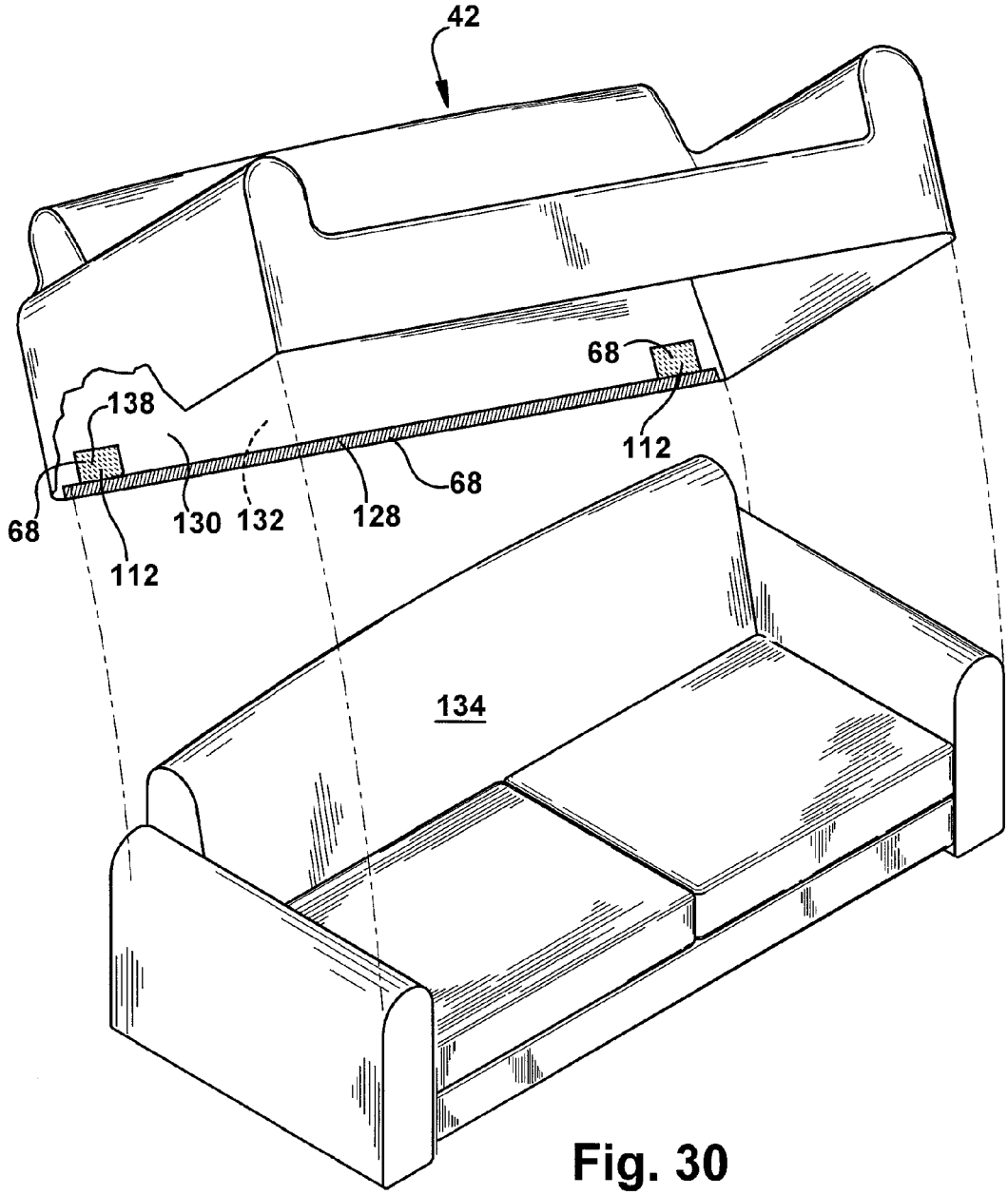
FIG. 30 depicts an exploded perspective view of a furniture cover having an example means for orienting the furniture cover on an item of furniture.

FIG. 30 is an alternative example where a furniture cover 42 utilizes the teachings discussed above. In particular, a sofa cover 126 is provided that utilizes color contrasting sections 128 that are affixed to an inner side 130 of the rear 132 of the cover 126. The color contrasting sections 128 may alternatively be labels 112. The user is provided with instructions to tell the user how to position the sofa cover 126 on the sofa 134. The color contrasting sections 128 are hidden from view once the cover 126 is installed so that a uniform appearance can be provided to the covered furniture 134. Any of the above-described means may be utilized with the furniture cover 126. In addition, while two color contrasting sections 128 are shown in the figure, a line of color contrasting material could be used, or other shapes for the color contrasting sections could be used (not shown). For example, the entire inner surface 130 of the rear 132 of the cover 126 could be dyed so that the user knows that is the back of the cover 126. Other sections of the furniture could alternatively be used for orienting, as long as the user is provided with appropriate instructions. It is preferred that the outer appearance of the cover 126 remain substantially uniform.

Figure 31:
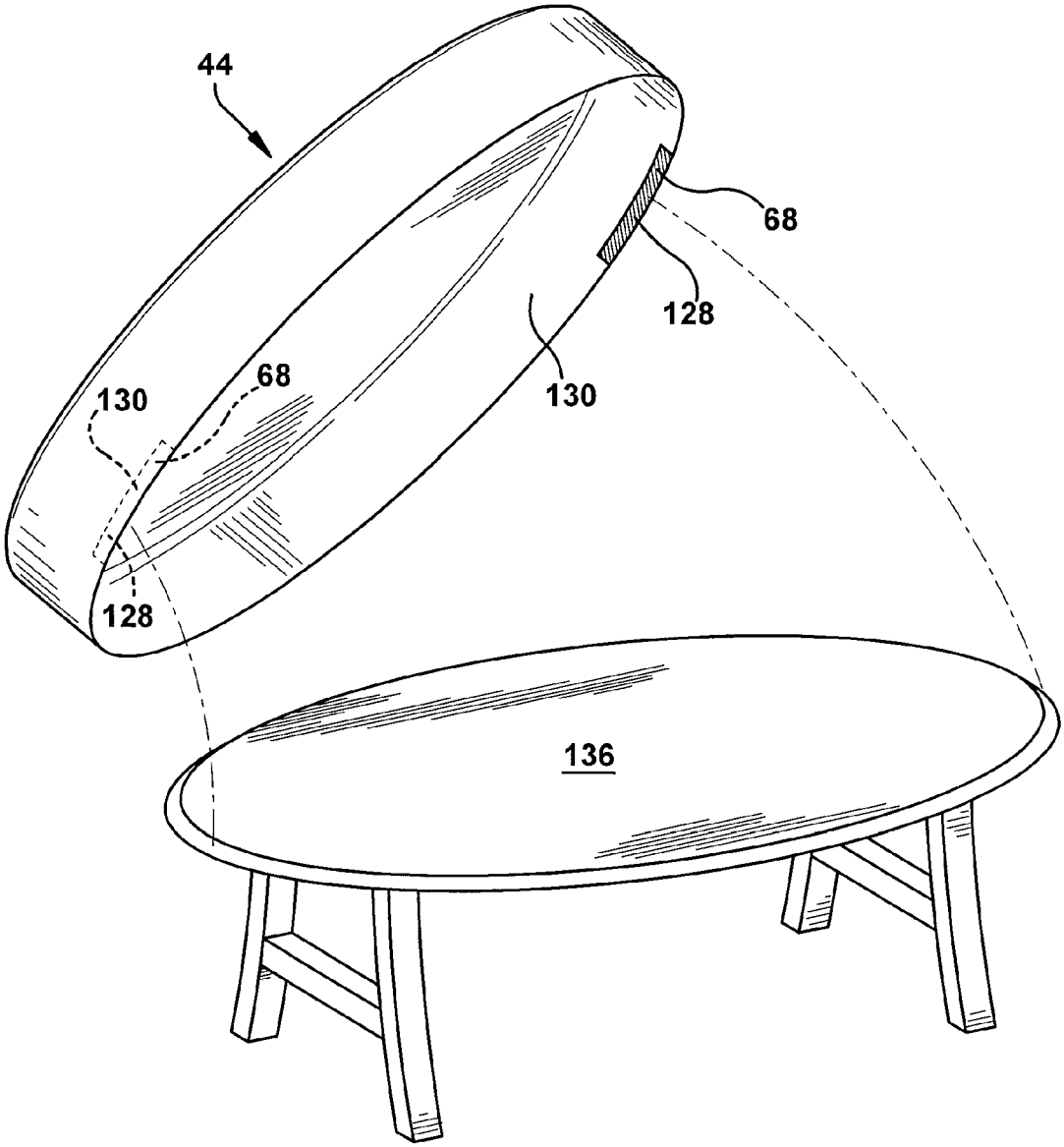
FIG. 31 depicts an exploded perspective view of a furniture cover having an example means for orienting the furniture cover on an item of furniture.

FIG. 31 depicts another alternative example of a furniture cover 42, which, in this case, is a cover for a table 136. Because the table 136 is oval-shaped, two color contrasting sections 128 are provided, preferably on an underside 130 of the covering 126 so that the covering 126 provides a uniform appearance once installed on the table 126. In this case, the color contrasting sections 128 may be piping, tape, dyed sections, buttons, labels, or the like, that are used to denote the ends of the oval such that a user, with appropriate instructions, will know how to orient the covering 126 on the table 136 without experimentation.

Any type of covering in any size may benefit from the teachings described herein, the examples not being limited to a particular application. Moreover, any of the techniques for identifying sections of the cover, as described above, can be used with any of the examples. While the above described examples are primarily directed toward queen and twin size mattresses, other mattresses, such as those mentioned in the background section, may equally benefit from the inventive techniques described herein.

The term "substantially," if used herein, is a term of estimation.

While various features are presented above, it should be understood that the features may be used singly or in any combination thereof. Further, it should be understood that variations and modifications may occur to those skilled in the art to which the claimed examples pertain. The examples described herein are exemplary. The disclosure may enable those skilled in the art to make and use alternative designs having alternative elements that likewise correspond to the elements recited in the claims. The intended scope may thus include other examples that do not differ or that insubstantially differ from the literal language of the claims. The scope of the disclosure is accordingly defined as set forth in the appended claims.

What is claimed is:

1. An article for use on a mattress comprising:

a bedding article; and means for orienting the bedding article on a mattress lengthwise such that a user can identify the width versus height of the bedding article so as to properly orient the bedding article on a mattress without experimentation, wherein the means for orienting the bedding article on a mattress is one or more of a color contrasting section, and the bedding article has two sides, a top end, a bottom end, and an opening for seating around the mattress, with an edge around the opening, and four corners, with two corners being at the top end and two corners being at the bottom end, with the means for orienting the bedding article being associated with one or more corners of the bedding article, wherein the bedding article includes corner straps that aid in securing the bedding article to the mattress and the color contrasting sections are provided by one or more of the corner straps.

2. The article of claim 1, wherein the means for orienting the bedding article on a mattress is hidden from view under the mattress when the bedding article is installed on a mattress.

3. The article of claim 1, wherein the bedding article comprises four corner straps and two of the corner straps are color contrasting sections and the other two corner straps are white in color, with the color contrasting sections having a color that is other than white.

4. The article of claim 1, wherein the color contrasting sections have a color that is selected from the group of gold, silver, red, blue, yellow, green, orange, purple, white, or black.

5. An article for use as a cover for an underlying item comprising:

a cover article; and means for orienting the cover article on an underlying item, wherein the means for orienting the cover article on an underlying item is one or more of a color contrasting section, indicia, label, or stitching, with the means for orienting being hidden from view when the cover article is installed on an underlying item and being associated with two of the corners of the cover article.

6. An article for use on a mattress comprising:

a bedding article having two sides, a top end, a bottom end, and an opening for seating around the mattress and four corners, with two of the corners being at the top end and two of the corners being at the bottom end; and at least two like contrasting elements coupled to the bedding article for assisting a user in identifying at least one of the top and bottom of the bedding article in order to orient the bedding article on a mattress lengthwise such that a user can identify the width versus height of the bedding article to properly orient the bedding article on a mattress without experimentation, said at least two contrasting elements being utilized by a user to identify one or more of the top or bottom of the bedding article.

7. The article of claim 6, further comprising a plurality of corner straps, wherein the at least two contrasting elements are one or more of the plurality of corner straps and have a color that is different from a color of other corner straps associated with the bedding article.

8. An article for use on a mattress comprising:

a bedding article having a plurality of corners; and a standard part of the bedding article having at least one color contrasting element positioned on the bedding article for orienting the bedding article on a mattress lengthwise such that a user can identify the width versus height of the bedding article so as to properly orient the bedding article on a mattress without experimentation, with the at least one color contrasting element being associated with one or more corners of the bedding article or being positioned under the mattress when the bedding article is installed thereon.

9. The article of claim 8, wherein the at least one color contrasting element is hidden from view under the mattress when the bedding article is installed on the mattress.

* * * * *